US012012688B2

(12) United States Patent
Park et al.

(10) Patent No.: US 12,012,688 B2
(45) Date of Patent: Jun. 18, 2024

(54) LAUNDRY TREATING APPARATUS

(71) Applicant: LG Electronics Inc., Seoul (KR)

(72) Inventors: Junghyun Park, Seoul (KR); Minseok Choi, Seoul (KR); Unkeol Yeo, Seoul (KR)

(73) Assignee: LG Electronics Inc., Seoul (KR)

( * ) Notice: Subject to any disclaimer, the term of this patent is extended or adjusted under 35 U.S.C. 154(b) by 50 days.

(21) Appl. No.: 17/402,140

(22) Filed: Aug. 13, 2021

(65) Prior Publication Data

US 2022/0049406 A1 Feb. 17, 2022

(30) Foreign Application Priority Data

Aug. 14, 2020 (KR) ..... 10-2020-0102583

(51) Int. Cl.

| | |
|---|---|
| ***D06F 37/40*** | (2006.01) |
| ***D06F 13/02*** | (2006.01) |
| ***D06F 17/10*** | (2006.01) |
| ***D06F 37/12*** | (2006.01) |

(52) U.S. Cl.

CPC ..... *D06F 37/40* (2013.01); *D06F 13/02* (2013.01); *D06F 17/10* (2013.01); *D06F 37/12* (2013.01)

(58) Field of Classification Search

CPC ..... D06F 13/02; D06F 17/10; D06F 37/12; D06F 37/40

See application file for complete search history.

(56) References Cited

U.S. PATENT DOCUMENTS

| | | | | |
|---|---|---|---|---|
| 3,987,652 | A * | 10/1976 | Ruble | D06F 13/00 68/134 |
| 4,155,228 | A | 5/1979 | Burgener, Jr. et al. | |
| 4,787,220 | A | 11/1988 | Noh | |
| 4,871,505 | A * | 10/1989 | Lapeyre | B29C 33/44 249/59 |
| 6,065,936 | A | 5/2000 | Shingai et al. | |
| 2004/0016267 | A1* | 1/2004 | Clark | D06F 13/02 68/133 |
| 2005/0284197 | A1* | 12/2005 | Pinkowski | D06F 13/02 68/133 |

(Continued)

FOREIGN PATENT DOCUMENTS

| | | |
|---|---|---|
| CN | 104786390 | 7/2015 |
| EP | 0161787 | 8/1990 |

OTHER PUBLICATIONS

PCT International Search Report and Written Opinion in International Appln No. PCT/KR2021/010590, dated Nov. 25, 2021, 10 pages.

*Primary Examiner* — Joseph L. Perrin
(74) *Attorney, Agent, or Firm* — Fish & Richardson P.C.

(57) ABSTRACT

A laundry treating apparatus includes a tub, a drum, and a rotator. The rotator includes a bottom portion positioned on a bottom surface of the drum, a pillar protruding from the bottom portion toward an open surface of the drum, and a blade disposed on an outer circumferential surface of the pillar. The blade extends obliquely with respect to a longitudinal direction of the pillar from one end thereof facing toward the bottom portion to the other end thereof facing toward the open surface, and a first mold line at least partially extending in parallel with a circumferential direction of the pillar is formed between said one end and the other end.

18 Claims, 17 Drawing Sheets

(56) References Cited

U.S. PATENT DOCUMENTS

| | | | | |
|---|---|---|---|---|
| 2007/0062224 | A1* | 3/2007 | La Belle | D06F 13/02 68/3 R |
| 2015/0204342 | A1* | 7/2015 | Liang | B29C 33/485 416/223 R |
| 2018/0313021 | A1* | 11/2018 | Piekarski | D06F 21/06 |
| 2018/0313022 | A1* | 11/2018 | Piekarski | D06F 37/145 |
| 2018/0313024 | A1* | 11/2018 | Piekarski | D06F 39/088 |
| 2022/0403580 | A1* | 12/2022 | Sreevidhas | D06F 37/12 |

* cited by examiner

LAUNDRY TREATING APPARATUS

CROSS-REFERENCE TO RELATED APPLICATIONS

This application claims the benefit of Korean Patent Application No. 10-2020-0102583, filed on Aug. 14, 2020, which is hereby incorporated by reference as if fully set forth herein.

TECHNICAL FIELD

The present disclosure relates to a laundry treating apparatus, and more particularly, to a laundry treating apparatus having a rotator disposed in a drum.

BACKGROUND

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a housing forming an appearance of the laundry treating apparatus, a tub accommodated in the housing, a drum that is rotatably mounted inside the tub and into which the laundry is put, and a detergent feeder that feeds detergent into the drum.

When the drum is rotated by a motor while wash water is supplied to the laundry accommodated in the drum, dirt on the laundry may be removed by friction with the drum and the wash water.

In one example, a rotator may be disposed inside the drum to improve a laundry washing effect. The rotator may be rotated inside the drum to form a water flow, and the laundry washing effect may be improved by the rotator.

Specifically, the rotator may include a pillar extending in a direction parallel to a rotation shaft of the drum, and a blade that forms a water flow when the pillar rotates may be disposed on an outer circumferential surface of the pillar.

With respect to the rotator, U.S. Pat. No. 941,741 discloses a rotator including a pillar having a blade formed thereon. The blade of the rotator extends in a curved form in some sections, and extends parallel to a longitudinal direction of the pillar in the remaining sections.

The rotator disclosed in U.S. Pat. No. 941,741 may be disadvantageous in terms of molding because the blade has a curved shape with an inclination angle varying in some sections, and may be disadvantageous in improving a washing efficiency because the blade extends parallel to the longitudinal direction of the pillar in the remaining section.

In addition, U.S. patent Ser. No. 15/067,294 discloses a rotator including vanes inclined with respect to the longitudinal direction of the pillar. A plurality of vanes are disposed along a longitudinal direction of the pillar, and have opposite inclination angles.

Because the rotator disclosed in U.S. patent Ser. No. 15/067,294 has the plurality of vanes having the different inclination angles from each other, ascending or descending of the water flow is difficult to occur when the rotator rotates, so that it may be disadvantageous in improving the washing efficiency through formation of a three-dimensional water flow.

In addition, U.S. Pat. No. 839,997 discloses a rotator including a blade extending in a zigzag form in some sections and extending in parallel with the longitudinal direction of a pillar in the remaining sections.

In the rotator of U.S. Pat. No. 839,997, because the blade extends in the zigzag form in some sections, it is difficult to generate one of the ascending water flow or the descending water flow during the rotation, which may be disadvantageous in improving the washing efficiency through the formation of the three-dimensional water flow.

In the laundry treating apparatus including the rotator that forms the water flow, it is an important task in the art to improve the washing efficiency with various rotation strategies by designing the rotator to be advantageous to the formation of the three-dimensional water flow when the rotator is rotated.

In addition, it is an important task in the art to develop an efficient method for manufacturing the rotator and to effectively manufacture the rotator capable of forming the three-dimensional water flow accordingly.

SUMMARY

Embodiments of the present disclosure are intended to provide a laundry treating apparatus including a rotator to which an effective scheme for manufacturing a rotator having a structure capable of improving a washing efficiency is applied.

In addition, embodiments of the present disclosure are intended to provide a laundry treating apparatus including a rotator that is manufactured to be structurally stable and efficient while minimizing a mold line.

In addition, embodiments of the present disclosure are intended to provide a laundry treating apparatus including a rotator having a structure capable of effectively improving a washing efficiency by forming a three-dimensional water flow.

In one embodiment of the present disclosure, a rotator disposed inside a drum may include a bottom portion and a pillar. The pillar may also be referred to as an agitator. The rotator according to one embodiment of the present disclosure may improve a washing efficiency and implement a washing scheme differentiated from a conventional scheme.

The bottom portion may also be referred to as a pulsator. In one embodiment of the present disclosure, a protrusion of the bottom portion may be constructed to have a shape of a whale tail and reduce resistance to water when rotating.

The protrusion of the bottom portion and the blade of the pillar may together form water flows at an upper portion and a lower portion of an interior of the drum together, thereby forming a differentiated water flow inside the drum and effectively improving a washing efficiency.

The pillar may have a plurality of blades. Each blade may have a shape of extending with inclination angle with respect to a longitudinal or a circumferential direction of the pillar. The blade may be extended while being wound around the pillar along the longitudinal direction of the pillar.

The protrusion and the blade may implement a dynamic water flow formation and washing mode together. The blades may be divided into three bodies and disposed on the pillar.

A rib for forming the water flow, that is, a protrusion may be disposed on the bottom portion, and the pillar may be formed in a hollow shape such that a thickness thereof gradually decrease upwardly.

The protrusion of the bottom portion may include a main protrusion, and the main protrusion may have a whale tail shape, that is, may have a side surface of a streamlined shape, so that a resistance to water may be effectively reduced and may have an effective linkage effect in a relationship with the blade.

In addition, in one embodiment of the present disclosure, the rotator may be manufactured using a rotation extraction mold. Accordingly, the blade of the rotator does not have a parting line at an end thereof facing toward the open surface of the drum, so that mechanical rigidity may be secured during rotation and it may be advantageous for water flow formation.

A laundry treating apparatus according to an embodiment of the present disclosure may include a tub, a drum, and a rotator. The tub may provide therein a space for water to be stored, the drum may be rotatably disposed inside the tub, and include an open surface for inserting and withdrawing laundry therethrough and a bottom surface located on an opposite side of the open surface.

The rotator may be rotatably disposed on the bottom surface and inside the drum, and may include a bottom portion, a pillar, and a blade. The bottom portion may be positioned on the bottom surface, the pillar may protrude from the bottom portion toward the open surface, and the blade may be disposed on an outer circumferential surface of the pillar.

The blade may extend obliquely with respect to a longitudinal direction of the pillar from one end thereof facing toward the bottom portion to the other end thereof facing toward the open surface, and a first mold line at least partially extending in parallel with a circumferential direction of the pillar may be formed between said one end and the other end.

The first mold line may extend continuously along an outer surface of the blade and an outer surface of the pillar.

The blade may have a constant inclination angle with respect to the longitudinal direction of the pillar from the first mold line to the other end.

The first mold line may be located closer to said one end than to the other end of the blade. The blade may have only one first mold line formed on an outer surface thereof.

The blade may be formed with a first height reduction section extending from the first mold line to said one end with a protruding height from the pillar gradually decreasing.

The blade may be formed with a height maintaining section extending between the first height reduction section and the other end with the constant protruding height from the pillar. The blade may be formed with a second height reduction section from the height maintaining section to the other end with the protruding height from the pillar gradually decreasing.

A plurality of second mold lines extending parallel to a radial direction of the bottom portion may be formed on the bottom portion. The bottom portion may be constructed such that there is no mold line other than the second mold line on an outer surface of the bottom portion.

The first mold line may extend continuously along an outer surface of the blade and an outer surface of the pillar, and the second mold line may extend from a circumference of the bottom portion to the first mold line.

The blade may have said one end spaced apart from the second mold line along the circumferential direction of the pillar. The rotator may further include a main protrusion protruding from the bottom portion toward the open surface and extending from the pillar toward a circumference of the bottom portion.

Said one end of the blade may be spaced apart from the main protrusion along the longitudinal direction of the pillar. The main protrusion may include a plurality of main protrusions spaced apart from each other along the circumferential direction of the bottom portion, and each second mold line may be formed on an outer surface of each main protrusion.

The rotator may further include a first sub-protrusion disposed between a pair of neighboring main protrusions, wherein the first sub-protrusion protrudes from the bottom portion toward the open surface, and extends along the radial direction of the bottom portion.

The rotator may further include a plurality of second sub-protrusions disposed between the first sub-protrusion and each of the pair of main protrusions, wherein the second sub-protrusion protrudes from the bottom portion to the open surface, and extends in a direction parallel to the extension direction of the first sub-protrusion.

The pillar may include an internal space defined therein, and a communication portion positioned parallel to the first sub-protrusion along a radial direction of the rotator, and concavely indented toward the internal space, wherein the communication portion includes a communication hole defined therein for communicating the internal space with the outside.

The pair of main protrusions may be constructed such that a width thereof along the circumferential direction of the bottom portion gradually increases from the pillar toward the circumference of the bottom portion.

Each of the pair of main protrusions may be constructed such that a side surface thereof facing toward the first sub-protrusion has no overlapping portion along a direction parallel to the extension direction of the first sub-protrusion.

An entirety of a side surface facing toward the first sub-protrusion of each of the pair of main protrusions may be exposed when viewed in the direction parallel to the extension direction of the first sub-protrusion.

The bottom portion may have an open space defined therein opened toward the bottom surface of the drum, and a portion of the open space of the bottom portion may be defined inside the main protrusion.

The bottom portion may have a reinforcing portion for defining the open space thereof and protruding toward the bottom surface from an inner surface of the bottom portion facing toward the bottom surface of the drum.

The pillar may have an internal space defined therein, an end surface of the pillar facing toward the open surface of the drum may be opened, and a cap for shielding the end surface may be coupled to the pillar.

The pillar may be constructed such that an inner diameter thereof is gradually reduced from an end thereof facing toward the open surface to the bottom portion. The pillar may be constructed such that an outer diameter thereof is gradually increased from an end thereof facing toward the open surface to the bottom portion.

The pillar may have a cap-coupled-portion to be coupled to the cap at an end thereof facing toward the open surface, the cap-coupled-portion may be constructed to surround the end surface, and a third mold line extending parallel to the longitudinal direction of the pillar may be formed on the cap-coupled-portion.

The cap-coupled-portion may include a hook coupled to the cap, the third mold line may include a plurality of third mold lines spaced apart from each other along the circumferential direction of the pillar, and each hook may be positioned between a pair of neighboring third mold lines.

In one example, in the laundry treating apparatus according to an embodiment of the present disclosure, the blade may extend obliquely with respect to a longitudinal direction of the pillar from one end facing toward the bottom portion to the other end facing toward the open surface, and a first portion including said one end and a second portion including the other end of the blade may be molded by different molds, so that a first mold line may be formed between the first portion and the second portion.

Embodiments of the present disclosure may provide the laundry treating apparatus including the rotator to which the effective scheme for manufacturing the rotator having the structure capable of improving the washing efficiency is applied.

In addition, embodiments of the present disclosure may provide the laundry treating apparatus including the rotator that is manufactured to be structurally stable and efficient while minimizing the mold line.

In addition, embodiments of the present disclosure may provide the laundry treating apparatus including the rotator having the structure capable of effectively improving the washing efficiency by forming the three-dimensional water flow.

DETAILED DESCRIPTION

Figure 1:
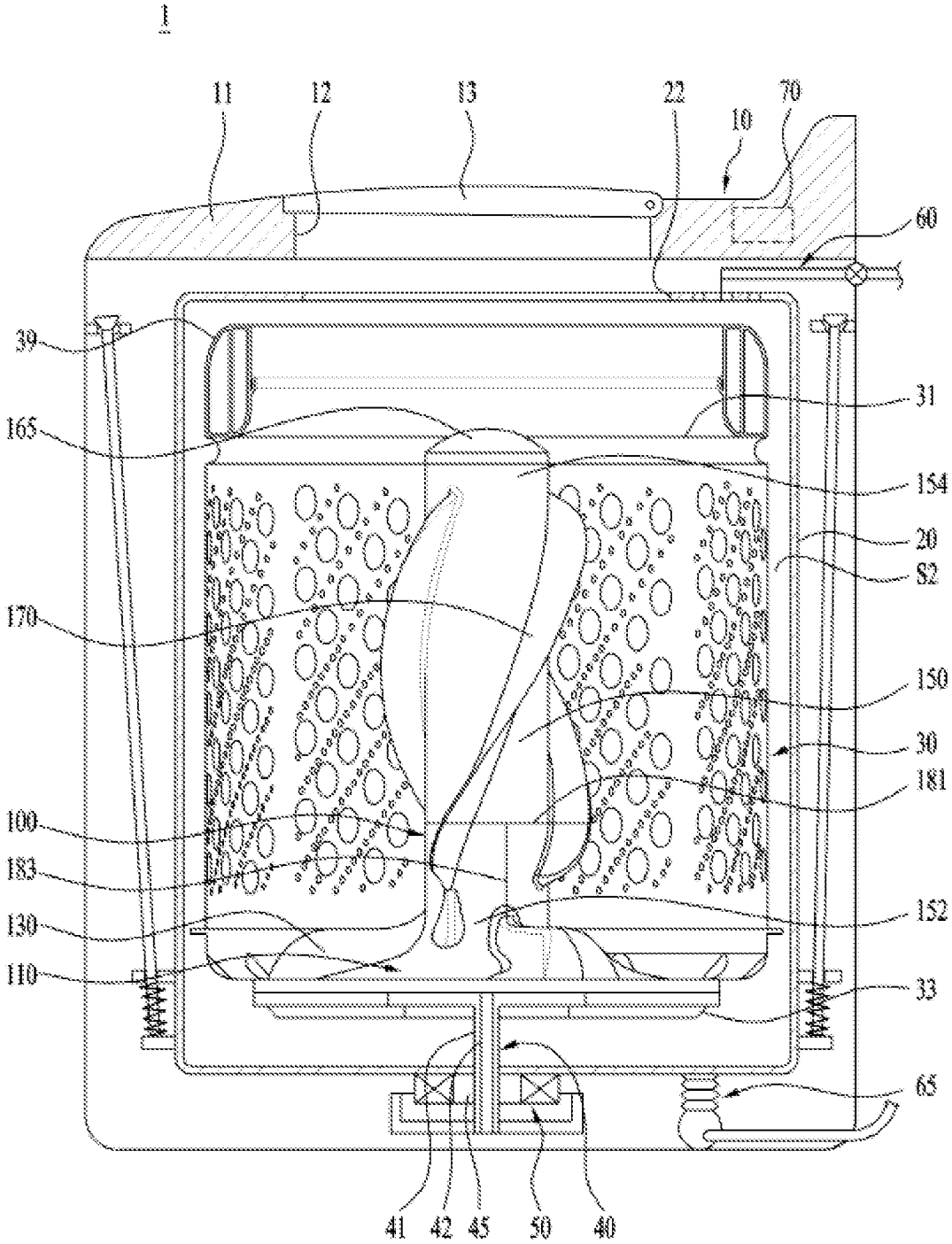
FIG. 1 is a view showing an interior of a laundry treating apparatus according to an embodiment of the present disclosure.

Hereinafter, an embodiment of the present disclosure will be described in detail with reference to the accompanying drawings such that a person having ordinary knowledge in the technical field to which the present disclosure belongs may easily implement the embodiment.

However, the present disclosure is able to be implemented in various different forms and is not limited to the embodiment described herein. In addition, in order to clearly describe the present disclosure, components irrelevant to the description are omitted in the drawings. Further, similar reference numerals are assigned to similar components throughout the specification.

Duplicate descriptions of the same components are omitted herein.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

The terminology used in the detailed description is for the purpose of describing the embodiments of the present disclosure only and is not intended to be limiting of the present disclosure.

As used herein, the singular forms 'a' and 'an' are intended to include the plural forms as well, unless the context clearly indicates otherwise.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in this specification, the term 'and/or' includes a combination of a plurality of listed items or any of the plurality of listed items. In the present specification, 'A or B' may include 'A', 'B', or 'both A and B'.

FIG. 1 shows an interior of a laundry treating apparatus 1 according to an embodiment of the present disclosure. The laundry treating apparatus 1 may include a cabinet 10, a tub 20, and a drum 30.

The cabinet 10 may be in any shape as long as being able to accommodate the tub 20, and FIG. 1 shows a case in which the cabinet 10 forms an appearance of the laundry treating apparatus 1 as an example.

In the cabinet 10, a laundry inlet 12 for supplying the laundry into the drum 30 or withdrawing the laundry stored in the drum 30 to the outside may be defined in one surface 11, and a laundry door 13 for opening and closing the laundry inlet 12 may be disposed on said one surface 11.

Said one surface 11 of the cabinet 10 may be a top surface of the cabinet 10. FIG. 1 shows a state in which the laundry inlet 12 is defined in the top surface of the cabinet 10, and the laundry door 13 for opening and closing the laundry inlet 12 is disposed on the top surface, according to one embodiment of the present disclosure. However, the laundry inlet 12 and the laundry door 13 are not necessarily limited to being defined in and disposed on the top surface of the cabinet 10.

The tub 20 may store water therein. The tub 20 is means for storing water necessary for washing the laundry therein. The tub 20 may have a tub opening 22 defined therein in communication with the laundry inlet 12.

For example, one surface of the tub 20 may be opened to define the tub opening 22. At least a portion of the tub opening 22 may be positioned to face the laundry inlet 12, so that the tub opening 22 may be in communication with the laundry inlet 12.

FIG. 1 shows a top loading type laundry treating apparatus 1 according to an embodiment of the present disclosure. Therefore, FIG. 1 shows that a top surface of the tub 20 is opened to define the tub opening 22, and the tub opening 22 is positioned below the laundry inlet 12 and in communication with the laundry inlet 12.

The tub 20 is fixed at a location inside the cabinet 10 through a support. The support may be in a structure capable of damping vibrations generated in the tub 20.

The tub 20 is supplied with water through a water supply 60. The water supply 60 may be composed of a water supply pipe that connects a water supply source with the tub 20, and a valve that opens and closes the water supply pipe.

The laundry treating apparatus 1 according to an embodiment of the present disclosure may include a detergent feeder 25 that stores detergent therein and is able to supply the detergent into the tub 20. As the water supply 60 supplies water to the detergent feeder 25, the water that has passed through the detergent feeder 25 may be supplied to the tub 20 together with the detergent.

In addition, the laundry treating apparatus 1 according to an embodiment of the present disclosure may include a water sprayer that sprays water into the tub 20 through the tub opening 22. The water supply 60 may be connected to the water sprayer to supply water directly into the tub 20 through the water sprayer.

The water stored in the tub 20 is discharged to the outside of the cabinet 10 through a drain 65. The drain 65 may be composed of a drain pipe that guides the water inside the tub 20 to the outside of the cabinet 10, and a drain pump disposed on the drain pipe.

The drum 30 may be rotatably disposed inside the tub 20. The drum 30 may include an open surface 31 through which the laundry is inserted and withdrawn, and a bottom surface 33 positioned on an opposite side of the open surface 31.

Specifically, the drum 30 may be rotatably disposed inside the tub 20. The drum 30 may be constructed to have a circular cross-section in order to facilitate the rotation inside the tub 20. For example, the drum 30 may be in a cylindrical shape as shown in FIG. 1.

The drum 30 may have the open surface 31 positioned below the tub opening 22 and in communication with the inlet. The top surface of the drum 30 may be opened to form the open surface 31, and the open surface 31 may be an inlet through which the laundry is put into the drum 30 through the tub opening 22.

A plurality of drum through-holes that communicate an interior and an exterior of the drum 30 with each other, that is, the interior of the drum 30 and an interior of the tub 20 divided by the drum 30 with each other may be defined in an outer circumferential surface of the drum 30. Accordingly, the water supplied into the tub 20 may be supplied to the interior of the drum 30 in which the laundry is stored through the drum through-holes.

The drum 30 may be rotated by a driver 50. The driver 50 may be composed of a stator fixed at a location outside the tub 20 and forming a rotating magnetic field when a current is supplied, a rotor rotated by the rotating magnetic field, and a rotation shaft 40 disposed to penetrate the tub 20 to connect the drum 30 and the like to the rotor.

As shown in FIG. 1, the rotation shaft 40 may be disposed to form a right angle with respect to a bottom surface 33 of the tub 20. In this case, the laundry inlet 12 may be defined in the top surface of the cabinet 10, the tub opening 22 may be defined in the top surface of the tub 20, and the open surface 31 of the drum 30 may correspond to the top surface of the drum 30.

In one example, when the drum 30 rotates in a state in which the laundry is concentrated in a certain region inside the drum 30, a dynamic unbalance state (an unbalanced state) occurs in the drum 30. When the drum 30 in the unbalanced state rotates, the drum 30 rotates while vibrating by a centrifugal force acting on the laundry. The vibration of the drum 30 may be transmitted to the tub 20 or the cabinet 10 to cause a noise.

To avoid problems like this, the present disclosure may further include a balancer 39 that controls the unbalance of the drum 30 by generating a force to offset or damp the centrifugal force acting on the laundry.

In one example, one embodiment of the present disclosure may include a controller 70 that adjusts a water supply amount by controlling the water supply 60 in a washing process and the like.

The controller 70 is configured to adjust the amount of water supplied to the tub 20 in the washing process, a rinsing process, or the like. The amount of water supplied may be adjusted through a manipulation unit disposed on the cabinet 10 and manipulated by a user, or may be determined through an amount of laundry, a load of the driver 50, or the like.

A plurality of water supply amounts are preset in the controller 70, and the controller 70 may be configured to control the water supply 60 based on one of the preset water supply amounts in response to a command selected by a user or the like in the washing process or the like.

In addition, the controller 70 may control the driver 50 to adjust the rotation of the rotator 100. That is, a rotation direction, a rotation speed, a rotation angle, and the like of the rotator 100 may be determined by the driver 50, and the driver 50 may be controlled by the controller 70.

In one example, as shown in FIG. 1, one embodiment of the present disclosure may further include a rotator 100. The rotator 100 may be rotatably installed on the bottom surface 33 and inside the drum 30. The water flow may be formed in the water inside the drum 30 through the rotation of the rotator 100, and a washing cycle of the laundry may be performed through the water flow formation.

In one embodiment of the present disclosure, the drum 30 and the rotator 100 may be constructed to be rotatable, independently. A water flow may be formed by the rotation of the drum 30 and the rotator 100, and friction or collision with the laundry may occur, so that washing or rinsing of the laundry may be made.

Figure 2:
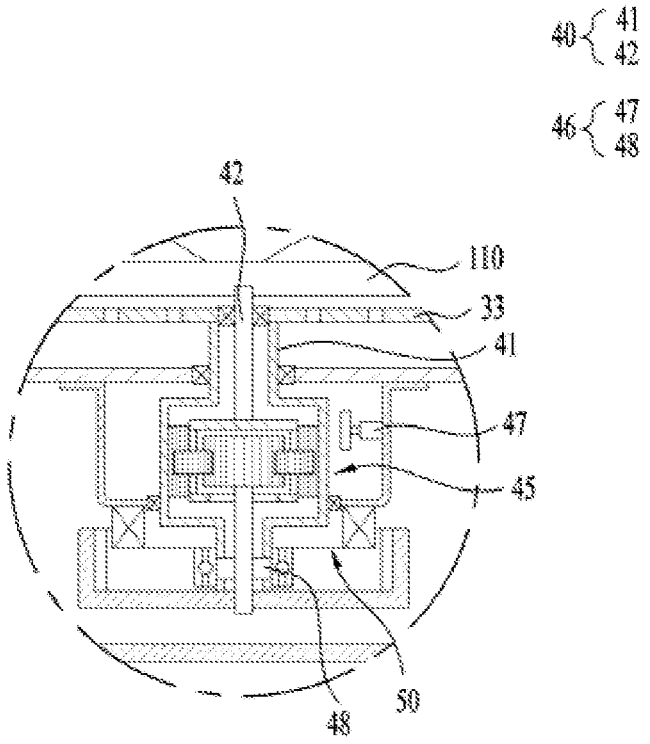
FIG. 2 is a view showing a rotation shaft and a gear set in a laundry treating apparatus according to an embodiment of the present disclosure.

FIG. 2 shows the rotation shaft 40 coupled with the drum 30 and the rotator 100 according to an embodiment of the present disclosure. Each of the drum 30 and the rotator 100 may be connected to the driver 50 through the rotation shaft 40 to receive a rotational force.

In one embodiment of the present disclosure, the drum 30 may be rotated as a first rotation shaft 41 is coupled to the bottom surface 33 thereof, and the rotator 100 may be rotated by being coupled to a second rotation shaft 42 that passes through the bottom surface 33 and separately rotated with respect to the first rotation shaft 41.

The second rotation shaft 42 may rotate in a direction the same as or opposite to a rotation direction of the first rotation shaft 41. The first rotation shaft 41 and the second rotation shaft 42 may receive power through one driver 50, and the driver 50 may be connected to a gear set 45 that distributes the power to the first rotation shaft 41 and the second rotation shaft 42 and adjusts the rotation direction.

That is, a driving shaft of the driver 50 may be connected to the gear set 45 to transmit the power to the gear set 45, and each of the first rotation shaft 41 and the second rotation shaft 42 may be connected to the gear set 45 to receive the power.

The first rotation shaft 41 may be constructed as a hollow shaft, and the second rotation shaft 42 may be constructed as a solid shaft disposed inside the first rotation shaft 41. Accordingly, one embodiment of the present disclosure may effectively provide the power to the first rotation shaft 41 and the second rotation shaft 42 parallel to each other through the single driver 50.

FIG. 2 shows a planetary gear-type gear set 45, and shows a state in which each of the driving shaft, the first rotation shaft 41, and the second rotation shaft 42 is coupled to the gear set 45. Referring to FIG. 2, a rotational relationship of the first rotation shaft 41 and the second rotation shaft 42 in one embodiment of the present disclosure will be described as follows.

The driving shaft of the driver 50 may be connected to a central sun gear in the planetary gear-type gear set 45. When the driving shaft is rotated, a satellite gear and a ring gear in the gear set 45 may rotate together by the rotation of the sun gear.

The first rotation shaft 41 coupled to the bottom surface 33 of the drum 30 may be connected to the ring gear positioned at the outermost portion of the gear set 45. The second rotation shaft 42 coupled to the rotator 100 may be connected to the satellite gear disposed between the sun gear and the ring gear in the gear set 45.

In one example, the gear set 45 may include a first clutch element 47 and a second clutch element 48 that may restrict the rotation of each of the rotation shafts 40 as needed. The gear set 45 may further include a gear housing fixed to the tub 20, and the first clutch element 47 may be disposed in the gear housing to selectively restrict the rotation of the first rotation shaft 41 connected to the ring gear.

The second clutch element 48 may be constructed to mutually restrict or release the rotations of the driving shaft and the ring gear. That is, the rotation of the ring gear or the rotation of the first rotation shaft 41 may be synchronized with or desynchronized with the driving shaft by the second clutch element 48.

In one embodiment of the present disclosure, when the first clutch element 47 and the second clutch element 48 are in the releasing state, the first rotation shaft 41 and the second rotation shaft 42 rotate in the opposite directions based on the rotational relationship of the planetary gear. That is, the drum 30 and the rotator 100 rotate in the opposite directions.

In one example, when the first clutch element 47 is in the restricting state, the rotations of the ring gear and the first rotation shaft 41 are restricted, and the rotation of the second rotation shaft 42 is performed. That is, the drum 30 is in a stationary state and only the rotator 100 rotates. In this connection, the rotation direction of the rotator 100 may be determined based on the rotation direction of the driver 50.

In one example, when the second clutch element 48 is in the restricting state, the rotations of the driving shaft and the first rotation shaft 41 are mutually restricted to each other, and the rotations of the driving shaft, the first rotation shaft 41, and the second rotation shaft 42 may be mutually restricted to each other by the rotational relationship of the planetary gear. That is, the drum 30 and the rotator 100 rotate in the same direction.

When the first clutch element 47 and the second clutch element 48 are in the restricting state at the same time, the driving shaft, the first rotation shaft 41, and the second rotation shaft 42 are all in the stationary state. The controller 70 may implement a necessary driving state by appropriately controlling the driver 50, the first clutch element 47, the second clutch element 48, and the like in the washing process, the rinsing process, and the like.

Figure 3:
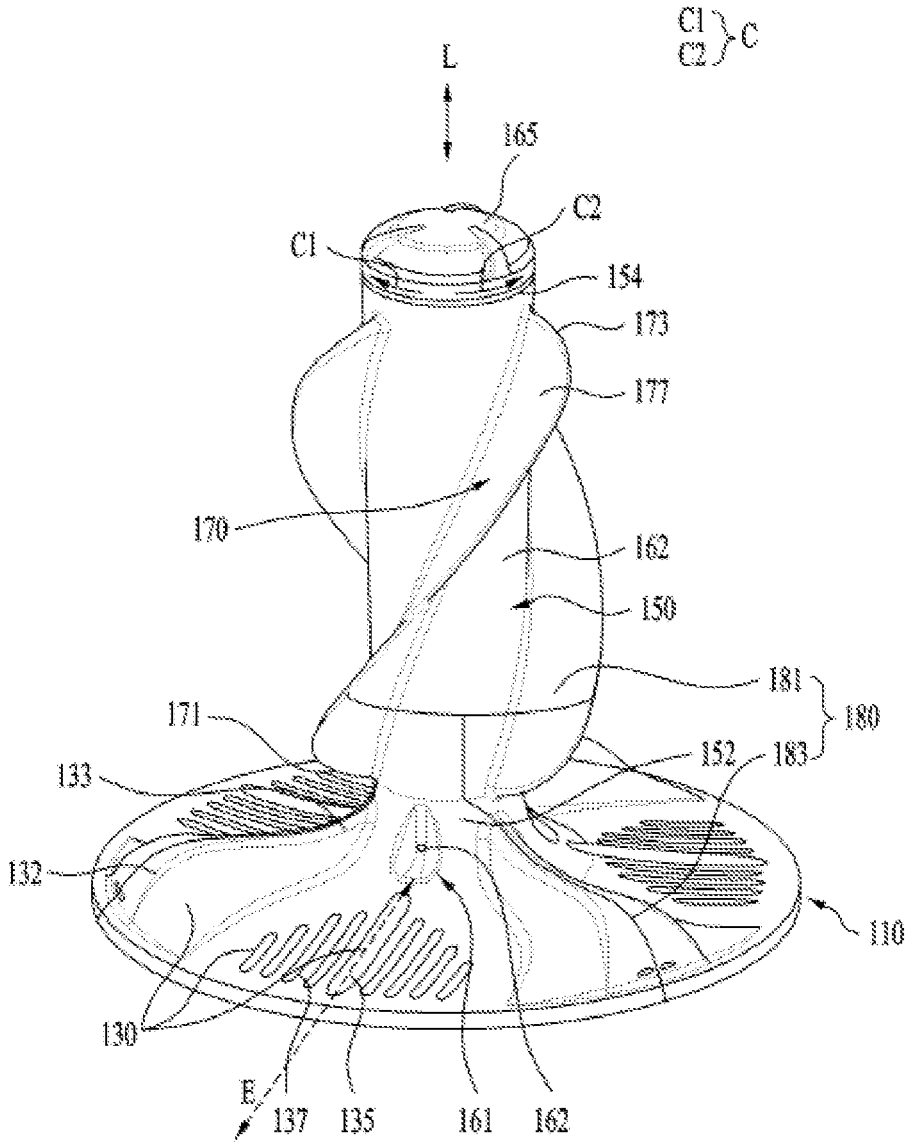
FIG. 3 is a perspective view of a rotator of a laundry treating apparatus according to an embodiment of the present disclosure.

In one example, FIG. 3 is a perspective view of the rotator 100 according to an embodiment of the present disclosure. In one embodiment of the present disclosure, the rotator 100 may include a bottom portion 110, a pillar 150, and a blade 170.

The bottom portion 110 may be located on the bottom surface 33 of the drum 30. The bottom portion 110 may be positioned parallel to the bottom surface 33 of the drum 30 to be rotatable on the bottom surface 33. The second rotation shaft 42 described above may be coupled to the bottom portion 110.

That is, the first rotation shaft 41 may be coupled to the drum 30, and the second rotation shaft 42 constructed as the solid shaft inside the hollow first rotation shaft 41 may penetrate the bottom surface of the drum 30 and be coupled to the bottom portion 110 of the rotator 100.

The rotator 100 coupled to the second rotation shaft 42 may rotate independently with respect to the drum 30. That is, the rotator 100 may be rotated in the direction the same as or opposite to that of the drum 30, and such rotation direction may be selected by the controller 70 or the like when necessary.

The first rotation shaft 41 may be coupled to a center of the bottom surface 33 of the drum 30. In the laundry treating apparatus 1 shown in FIG. 1, the top surface of the drum 30 may form the open surface 31, the bottom surface thereof may correspond to the bottom surface 33, and the drum 30 may have a side surface connecting the open surface 31 with the bottom surface 33, that is, an outer circumferential surface. For balancing the rotation, a cross-section of the drum 30 may have a circular shape. That is, the drum 30 may have a cylindrical shape having a space therein.

The second rotation shaft 42 may be coupled to a center of the bottom portion 110 of the rotator 100. The second rotation shaft 42 may be coupled to one surface facing the drum 30, that is, a bottom surface of the bottom portion 110, or the second rotation shaft 42 may pass through a center of the drum 30 to be coupled to the bottom portion 110.

The bottom portion 110 may have a circular cross-section in consideration of balancing of the rotation. The bottom portion 110 may be rotated about the second rotation shaft 42 coupled to the center thereof, and the center of the bottom portion 110 may coincide with the center of the drum 30.

The bottom portion 110 may basically have a disk shape, and a specific shape thereof may be determined in consideration of a connection relationship between a protrusion 130, the pillar 150, and the like as will be described later.

The bottom portion 110 may cover at least a portion of the bottom surface 33 of the drum 30. The bottom portion 110 may be constructed such that one surface thereof facing toward the bottom surface 33 of the drum 30 is spaced apart from the bottom surface 33 of the drum 30 to facilitate the rotation. A spaced distance between the bottom portion 110 and the bottom surface 33 of the drum 30 may be varied as needed.

The pillar 150 may have a shape protruding from the bottom portion 110 toward the open surface 31. Referring to FIG. 1, the pillar 150 may extend in a vertical direction. The pillar 150 may be integrally formed with the bottom portion 110.

The pillar 150 may be rotated together with the bottom portion 110. The pillar 150 may extend from the center of the bottom portion 110 toward the open surface 31. FIG. 1 shows the pillar 150 protruding upwardly from the bottom portion 110 according to an embodiment of the present disclosure.

The pillar 150 may have a circular cross-section, and a protruding height from the bottom portion 110 of the pillar 150 may vary. One end 152 of the pillar 150 may be connected to the bottom portion 110, and the other end 154 of the pillar 150 may face toward the open surface 31 of the drum 30. The pillar 150 may have an internal space 156 as will be described later, and an end surface 157 of the other end 154 may be opened, so that the internal space 156 may be opened toward the open surface 31.

A cap 165 for shielding the open end surface 157 may be coupled to the end of the pillar 150 facing toward the open surface 31, that is, the other end 154. The pillar 150 may form an outer circumferential surface by forming a curved side surface.

In one example, the rotator 100 may include a blade 170, and the blade 170 may be disposed on the outer circumferential surface of the pillar 150. The blade 170 may be constructed to protrude from the pillar 150, and may extend along the pillar 150 to form the water flow inside the drum 30 when the pillar 150 rotates.

A plurality of blades 170 may be disposed and spaced apart from each other along a circumferential direction C of the pillar 150, and may extend from the bottom portion 110 to the open surface 31 along a direction inclined with respect to a longitudinal direction L of the pillar 150.

That is, the blade 170 may extend obliquely with respect to the longitudinal direction L of the pillar 150 from one end 171 facing toward the bottom portion 110 to the other end 173 facing toward the open surface 31, and be formed in a screw shape.

Specifically, as shown in FIG. 3, the blade 170 may extend approximately along the longitudinal direction L of the pillar 150. The number of blades 170 may be equal to or greater than 1, and the number of blades may vary as needed. FIG. 3 shows a state in which three blades 170 are disposed on the outer circumferential surface of the pillar 150 according to an embodiment of the present disclosure.

The blades 170 may be uniformly disposed along the circumferential direction C of the pillar 150. That is, spaced distances between the blades 170 may be the same.

The blade 170 may extend along a direction inclined with respect to the longitudinal direction L or the circumferential direction C of the pillar 150. The blade 170 may extend obliquely from the bottom portion 110 to the open surface 31 on the outer circumferential surface of the pillar 150. An extended length of the blade 170 may be varied as needed.

As the blade 170 extends obliquely, when the rotator 100 is rotated, an ascending or descending water flow may be formed in the water inside the drum 30 by the blade 170 of the pillar 150.

For example, in one embodiment of the present disclosure, the rotator 100 may be rotated in one direction C1 and the other direction C2 along the circumferential direction C of the pillar 150, and the blade 170 may extend from a lower end to an upper end while being inclined toward the other direction C2 with respect to the longitudinal direction L of the pillar 150.

Therefore, when the rotator 100 rotates in said one direction C1, an ascending water flow may be formed by an inclined shape of the blade 170. In addition, when the rotator 100 is rotated in the other direction C2, a descending water flow may be formed by the blade 170.

In one embodiment of the present disclosure, as the plurality of blades 170 are disposed and spaced apart from each other, the water flow may be uniformly formed by the pillar. When the rotator 100 is rotated by the inclined extension form of the blade 170, not a simple rotational water flow, but the ascending water flow in which water at a lower portion of the drum 30 flows upward or the descending water flow in which water at an upper portion of the drum 30 flows downward may occur.

One embodiment of the present disclosure may form a three-dimensional water flow through the rotator 100, and thus greatly improve a washing efficiency for the laundry in the washing process. In addition, various washing schemes may be implemented by appropriately utilizing the ascending water flow and the descending water flow.

The blade 170 according to the present disclosure may have a screw shape. That is, the plurality of blades 170 may be disposed and be spaced apart from each other along the circumferential direction C of the pillar 150, and may extend in the form of the screw from the lower end facing toward the bottom portion 110 to the upper end facing toward the open surface 31.

In other words, in one embodiment of the present disclosure, the pillar 150 may extend from the lower end facing toward the bottom portion 110 to the upper end facing toward the open surface 31 while the plurality of blades 170 are wound on the outer circumferential surface of the pillar 150.

Figure 4:
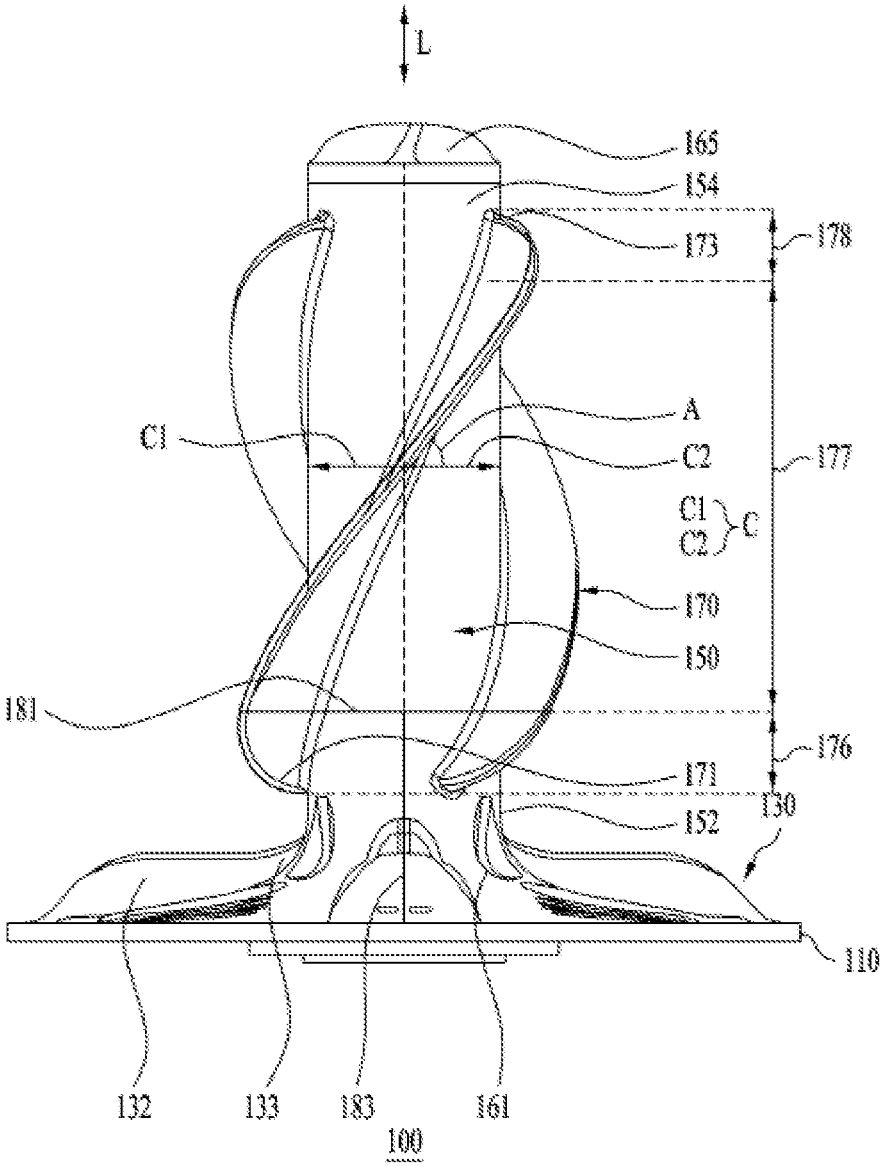
FIG. 4 is a side view of a rotator of a laundry treating apparatus according to an embodiment of the present disclosure.

In one example, FIG. 4 shows a side view of the rotator 100 according to an embodiment of the present disclosure. Referring to FIG. 4, in one embodiment of the present disclosure, the blade 170 may extend from the lower end to the upper end while being inclined toward the other direction C2 with respect to the longitudinal direction L of the pillar 150.

That is, the blade 170 may extend while forming an inclination angle A with respect to the rotation direction of the bottom portion 110 or the rotator 100, that is, the circumferential direction C of the pillar 150. Said one end 171 of the blade 170 may be more spaced in the other direction C2 than the other end 173.

When the inclination direction of the blade 170 is changed from the other direction C2 to said one direction C1 during the extension, during the rotation of the rotator 100, a portion of the blade 170 may generate the ascending water flow and the remaining portion may generate the descending water flow, so that it may be difficult to maximize the effect of either ascending or descending of the water.

Accordingly, in one embodiment of the present disclosure, the blade 170 may extend while only being inclined in the other direction C2 with respect to the longitudinal direction L of the pillar 150, the inclination angle A or the specific shape of the blade 170 may be variously determined.

Said one direction C1 may be one of a clockwise direction and a counterclockwise direction, and the other direction C2 may be the other one.

In one example, in one embodiment of the present disclosure, the blade 170 may continuously extend from said one end 171 to the other end 173. The blade 170 may extend from said one end 171 to the other end 173 to be continuously inclined with respect to the longitudinal direction L of the pillar 150. That is, the blade 170 may be formed in an inclined shape as a whole without a portion parallel to the longitudinal direction L of the pillar 150.

A length of the pillar 150 may be related to a washing performance and the load of the driver 50. For example, when the length of the pillar 150 is increased, the washing performance may be improved, but an excessive load may be applied to the driver 50. When the length of the pillar 150 is reduced, the load on the driver 50 may be reduced, but the washing performance may also be reduced.

Considering the above relationship, one embodiment of the present disclosure may determine a ratio between the length of the pillar 150 and a diameter of the bottom portion 110. When the length of the pillar 150 is too small, and when an amount of water supplied is large because of a large amount of laundry, because an area in which the water flow is formed by the pillar 150 and the blade 170 is reduced, the washing performance may be deteriorated.

When the length of the pillar 150 is too large, in the washing process, because a surplus length of the pillar 150 that is a length of a portion does not come into contact with the laundry and the water becomes excessive, it may lead to material loss and lead to an unnecessary load increase of the driver 50.

In one example, referring to FIGS. 3 and 4, in one embodiment of the present disclosure, the blade 170 may have a first mold line 181 formed between said one end 171 facing toward the bottom portion 110 and the other end 173 facing toward the open surface 31 of the drum 30. At least a portion of the first mold line 181 may extend parallel to the circumferential direction C of the pillar 150.

In one embodiment of the present disclosure, the rotator 100 may be manufactured through injection molding, and a mold apparatus 200 including a plurality of molds may be used for the injection molding of the rotator 100. The mold line means a line formed on a boundary between the plurality of molds on an outer surface of the rotator 100.

In a case of manufacturing an injection-molded product using the plurality of molds, a minute gap may exist between the molds, and the gap may form a line on an outer surface of the injection-molded product.

The line formed as above is defined as the mold line in one embodiment of the present disclosure. In one embodiment of the present disclosure, the first mold line 181 extending in the direction parallel to the circumferential direction C of the pillar 150 may be formed on the blade 170.

In one embodiment of the present disclosure, the rotator 100 includes the pillar 150 and the bottom portion 110, and the blade 170 extending obliquely is disposed on the pillar 150, so that injection molding of a rotation extraction scheme may be performed in order to mold the pillar 150 on which the blade 170 is disposed.

The rotation extraction scheme as described above may be efficient in integrally molding the blade 170 extending obliquely along the longitudinal direction L of the pillar 150 with the pillar 150. As the mold line that may be formed on the pillar 150 and the blade 170 is minimized, a structurally stable rotator 100 may be molded.

FIGS. 13 to 17 show the mold apparatus 200 for molding the rotator 100 according to an embodiment of the present disclosure. A scheme for manufacturing the rotator 100 according to an embodiment of the present disclosure will be described with reference to FIGS. 13 to 17 as follows.

Figure 13:
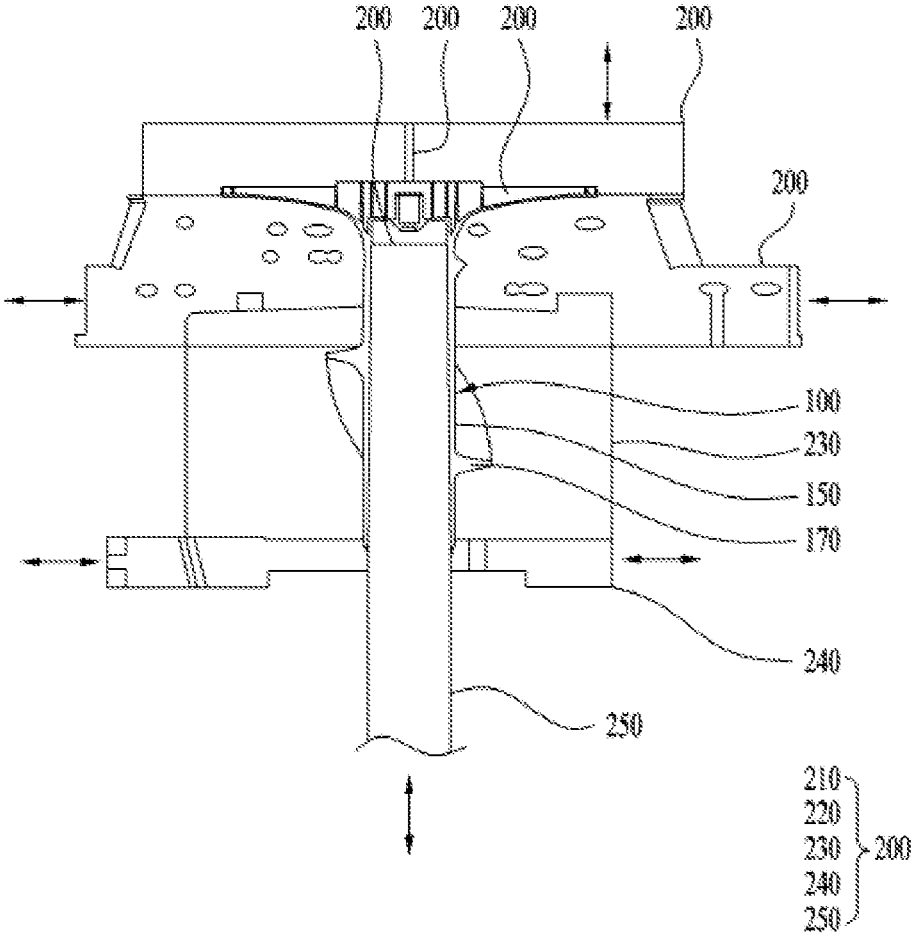
FIG. 13 is a view showing a mold apparatus capable of manufacturing a rotator of a laundry treating apparatus according to an embodiment of the present disclosure.

FIG. 13 shows the mold apparatus 200 for manufacturing the rotator 100 according to an embodiment of the present disclosure. Referring to FIG. 13, the mold apparatus 200 may include a closing mold 210, a first slide mold 220, a rotation extraction mold 230, a second slide mold 240, and an extraction guide 250.

FIG. 13 shows a state in which the closing mold 210, the first slide mold 220, the rotation extraction mold 230, and the second slide mold 240 are all coupled to each other. A space having a shape of the rotator 100 as a whole may be defined interior of the molds coupled to each other as shown in FIG. 13. Injection liquid may be injected into the space through an injection liquid injection portion 212 defined in the closing mold 210. In addition, when the injection liquid is cooled and the rotator 100 is molded, the rotator 100 may be extracted from the mold apparatus 200 through movement of the molds. The extracted rotator 100 may be subjected to out-of-mold cooling at a location outside the mold apparatus 200.

Manufacturing characteristics of the rotator 100 based on each mold in the mold apparatus 200 shown in FIG. 13 will be generally described as follows.

The bottom portion 110 of the rotator 100 may be formed in the first slide mold 220. That is, the first slide mold 220 may have a space defined therein in which the bottom portion 110 of the rotator 100 is formed.

A portion where the pillar 150 and the bottom portion 110 of the rotator 100 are connected to each other, that is, at least a portion of said one end 152 of the pillar 150 facing toward the bottom portion 110 and said one end 171 of the blade 170 facing toward the bottom portion 110 may be molded inside the first slide mold 220.

At least a portion of the pillar 150 and the blade 170 of the rotator 100 may be molded inside the rotation extraction mold 230. That is, the rotation extraction mold 230 may have a space defined therein in which the pillar 150 and the blade 170 are formed.

The rotation extraction mold 230 may have a pillar molding hole in which the pillar 150 is formed. A blade molding groove having a shape corresponding to the shape of the blade 170 may be defined in an inner circumferential surface of the pillar molding hole.

The rotation extraction mold 230 may provide therein a space in which the pillar 150 and blade 170 are molded. The pillar 150 and the blade 170 may be extracted from the rotation extraction mold 230 while being moved in a direction toward the bottom portion 110 and rotated along an inclination direction of the blade 170.

The inclination direction of the blade 170 may be a direction from said one end 171 to the other end 173 of the blade 170. For example, the blade 170 may be constructed to form the ascending water flow when the rotator 100 rotates in said one direction C1, and the blade 170 may extend obliquely from said one end 171 to the other direction C2 opposite to the one direction C1. In this case, the rotator 100 may be extracted from the rotation extraction mold 230 while being rotated in the other direction C2.

In one example, as will be described later, the pillar 150 may be formed in a hollow shape, and the cap 165 may be coupled to the end of the pillar 150 facing toward the open surface 31. A cap-coupled-portion 158 to which the cap 165 is coupled may be disposed at the end of the pillar 150.

The second slide mold 240 may be constructed to mold the cap-coupled-portion 158 of the pillar 150 therein. The second slide mold 240 may have a space defined therein in which the cap-coupled-portion 158 of the pillar 150 is formed.

One end of the extraction guide 250 may be inserted into the pillar molding hole of the rotation extraction mold 230. The extraction guide 250 may be constructed to extract the rotator 100 from the rotation extraction mold 230 by pushing the rotator 100 toward the bottom portion 110.

The extraction guide 250 may be moved along the longitudinal direction L of the pillar 150 through a moving portion moved by the driver. The extraction guide 250 may be moved toward the rotator 100 while being rotated along the inclination direction of the blade to correspond to the rotation of the rotator 100.

Said one end of the extraction guide 250 may be inserted into the pillar 150 to form the pillar 150 in a hollow shape.

The extraction guide 250 may further include a secondary extracting portion 252 that is located at least partially on said one end, and secondarily extracts the rotator 100, which is firstly extracted by the extraction guide 250, from the interior of the pillar 150.

In one example, a process of performing rotation extraction of the rotator 100 according to one embodiment of the present disclosure will be described with reference to FIGS. 13 to 17.

FIG. 13 shows a molding process of the rotator 100 in the manufacturing process of the rotator 100. In the molding process of the rotator 100, the plurality of molds equipped in the mold apparatus 200 are all in a coupled state, so that the rotator 100 may be molded therein.

In the mold apparatus 200, the plurality of molds are all in the coupled state, so that spaces respectively defined in the plurality of molds are in communication with each other to define a single space. The injection liquid may be injected into the space to form the rotator 100.

In the molding process of the rotator 100, at least a portion of the extraction guide 250 including said one end facing toward the rotator 100 may be inserted into the pillar 150 of the rotator 100 inside the rotation extraction mold 230. The pillar 150 may be molded in a hollow shape by the insertion of the extraction guide 250.

Because the pillar 150 has the hollow shape, it is possible to reduce a weight and materials required for manufacturing, and it is possible to reduce an occurrence of unbalance resulted from spacing between a center of gravity and a center of rotation.

In one example, after the molding process of the rotator 100 shown in FIG. 13, the mold apparatus 200 may perform a mold movement process in which the closing mold 210, the first slide mold 220, and the second slide mold 240 are moved away from the rotator 100.

Figure 14:
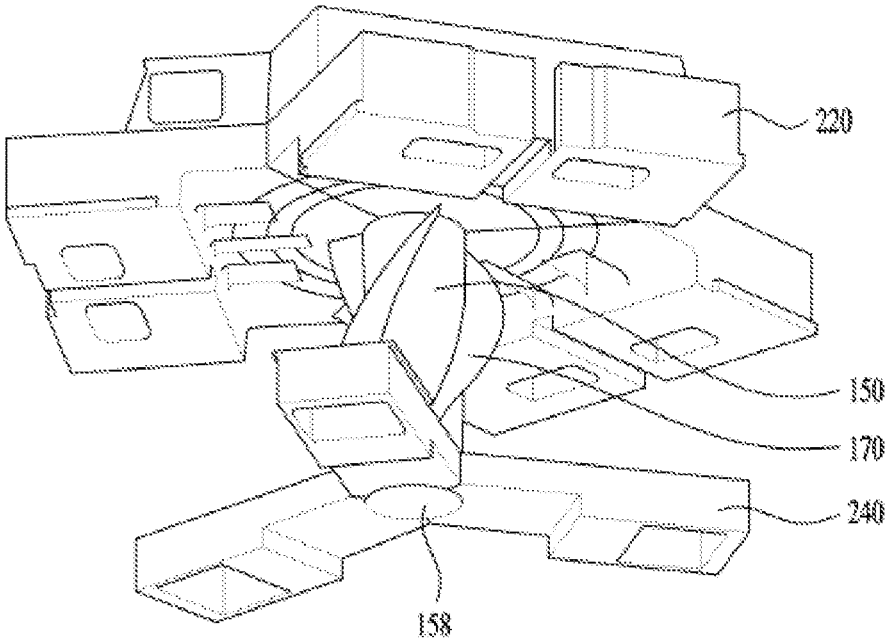
FIG. 14 is a view showing a state in which a rotation extraction mold is removed from a mold apparatus in FIG. 13.

FIG. 14 shows the first slide mold 220 and the second slide mold 240 that slide in the mold apparatus 200. In the mold apparatus 200 in FIG. 14, the rotation extraction mold 230 is omitted for convenience of understanding.

Figure 15:
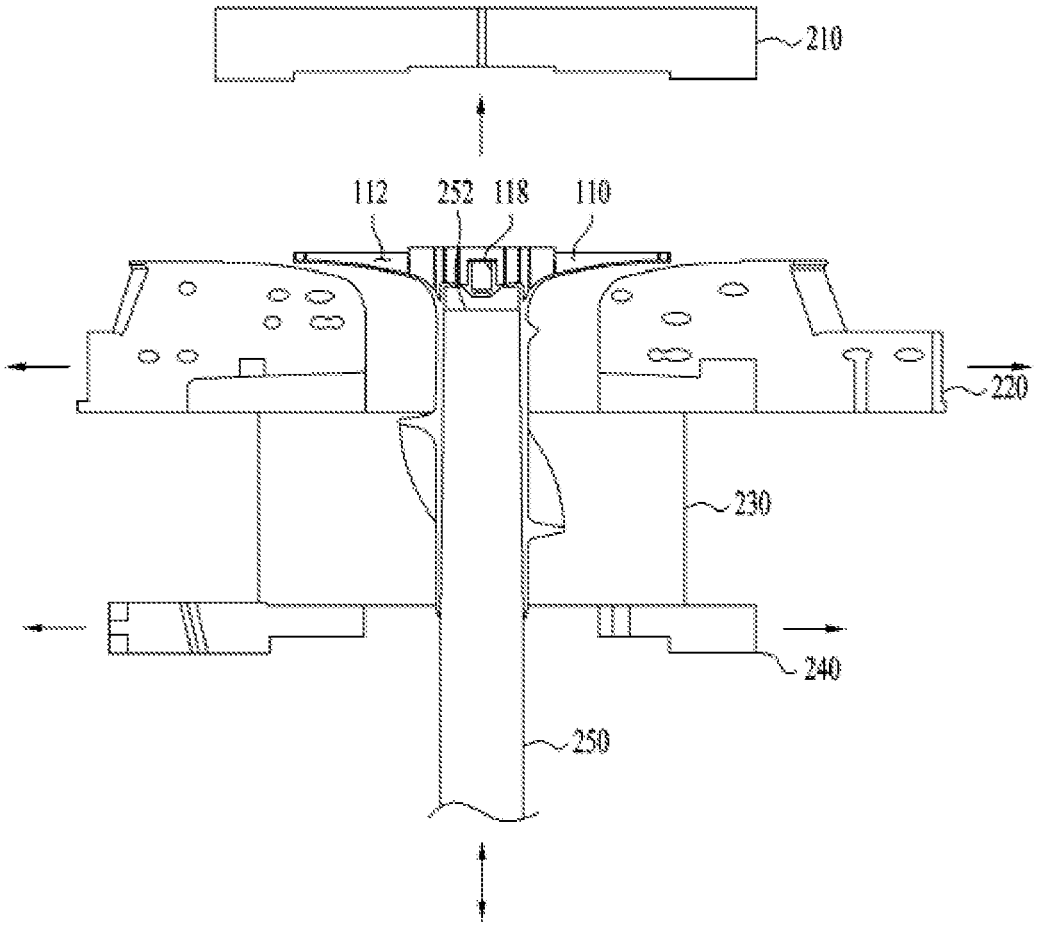
FIG. 15 is a view showing a state in which a closing mold and a slide mold are separated from a mold apparatus in FIG. 13.

FIG. 15 shows a state in which the closing mold 210, the first slide mold 220, and the second slide mold 240 are moved away from the rotator 100 as the mold movement process is performed after the molding process of the rotator 100 in FIG. 13.

The closing mold 210 may be constructed to define a space in which the bottom portion 110 of the rotator 100 is formed together with the first slide mold 220. One surface of the bottom portion 110 facing toward the bottom surface 33 of the drum 30 may be shaped by the closing mold 210. Said one surface of the bottom portion 110 may be opened by the closing mold 210 to define an open space 112 that is opened toward the bottom surface 33 of the drum 30 therein.

The closing mold 210 may be constructed to be movable along the longitudinal direction L of the pillar 150, and may be moved away from the bottom portion 110 of the rotator 100 during the mold movement process. The closing mold 210 may be moved along the longitudinal direction L of the pillar 150 and may mold said one surface of the bottom portion 110 of the rotator 100 facing toward the bottom surface 33 of the drum 30.

The first slide mold 220 may be constructed to define a space therein in which the bottom portion 110 is molded together with the closing mold 210. The first slide mold 220 may be constructed to be movable along a radial direction of the bottom portion 110, and may be constructed to be moved away from the bottom portion 110 during the mold movement process.

The first slide mold 220 may be composed of a plurality of divided bodies. The plurality of divided bodies may be disposed along a circumferential direction of the bottom portion 110, and may be constructed to be movable along the radial direction of the bottom portion 110.

Because the first slide mold 220 is composed of the plurality of divided bodies disposed along the circumferential direction of the bottom portion 110 and the divided bodies are moved along the radial direction of the bottom portion 110, the bottom portion 110 may have a shape molded along the radial direction. For example, the protrusions 130 disposed on the bottom portion 110 may extend in the radial direction of the bottom portion 110.

The second slide mold 240 may define therein a space in which the cap-coupled-portion 158 formed at the end of the pillar 150 is molded together with the extraction guide 250. For example, the extraction guide 250 may be positioned on an inner circumferential surface of the cap-coupled-portion 158, and the second slide mold 240 may be positioned on an outer circumferential surface of the cap-coupled-portion 158.

The second slide mold 240 may be constructed to be movable along the radial direction of the pillar 150, and may be moved away from the pillar 150 during the mold movement process.

The second slide mold 240 may be composed of a plurality of divided bodies. The number of divided bodies may vary. FIG. 14 shows a state in which each of the first slide mold 220 and the second slide mold 240 is composed of the three divided bodies.

The plurality of divided bodies constituting the second slide mold 240 may be disposed along the circumferential direction C of the pillar 150, and may be constructed to be movable along the radial direction of the pillar 150.

In the mold movement process, as shown in FIG. 15, the plurality of molds are moved away from the rotator 100, so that the pillar 150 may become in a state capable of being extracted from the rotation extraction mold 230.

Figure 16:
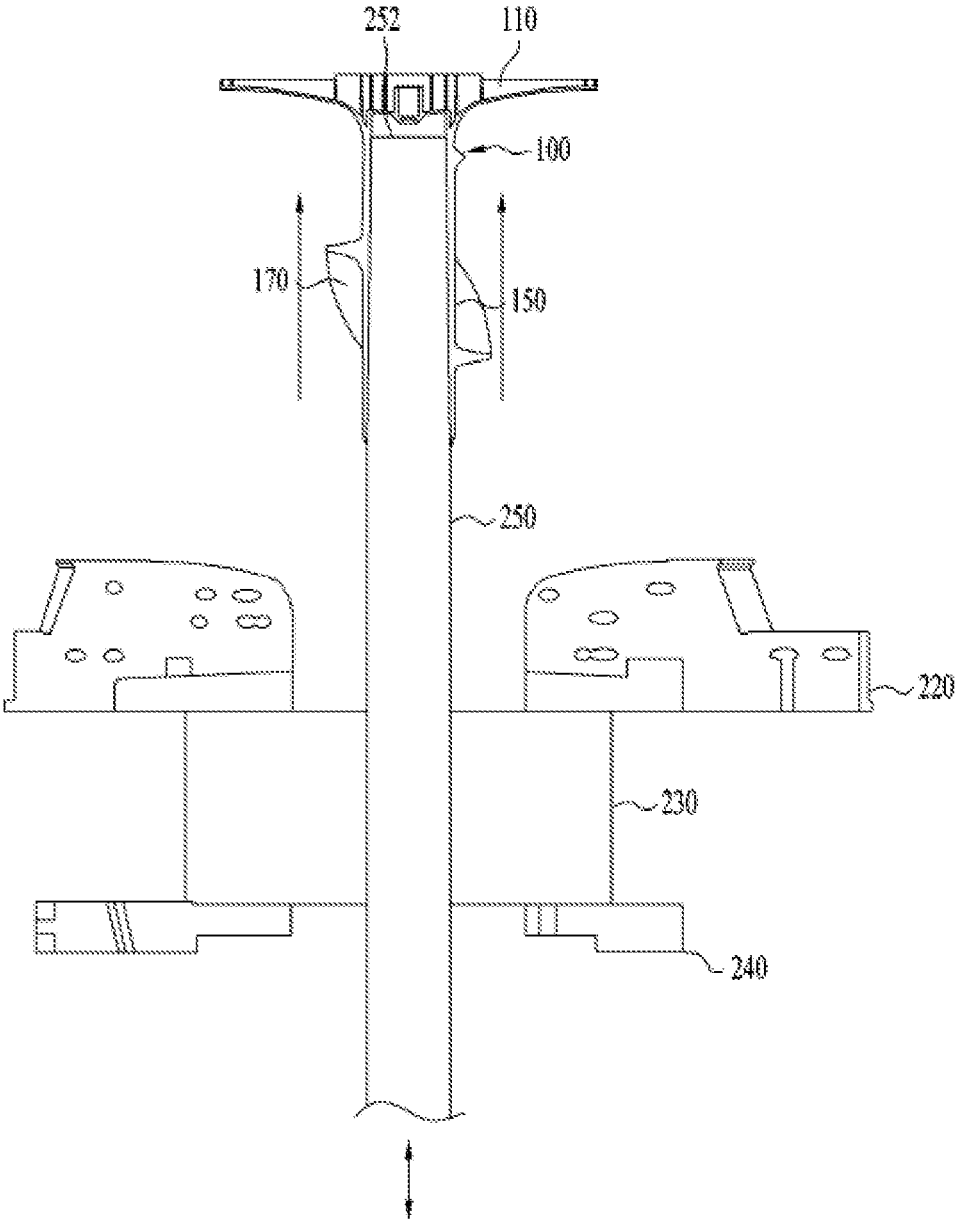
FIG. 16 is a view showing a state in which a rotator is primarily extracted from a mold apparatus in FIG. 15.

FIG. 16 shows a primary extraction process in which the rotator 100 is extracted from the rotation extraction mold 230 by the extraction guide 250 after the mold movement process in FIG. 15.

In the primary extraction process, said one end of the extraction guide 250 that is positioned inside the pillar 150 pushes the rotator 100 toward the bottom portion 110 to extract the pillar 150 from the rotation extraction mold 230.

Because the blade 170 of the pillar 150 does not have an extension direction parallel to the longitudinal direction L of the pillar 150 and extends obliquely with respect to the longitudinal direction L, during the rotation extraction, the pillar 150 may be extracted while being rotated along the inclination direction of the blade 170.

Because the pillar 150 is molded together with the blade 170 in a single mold, a parting line is not formed between the pillar 150 and the blade 170, so that a commercial value may be improved. In addition, the blade 170 may have a three-dimensional shape extending obliquely along the longitudinal direction L of pillar 150 through the rotation extraction.

Furthermore, because the pillar 150 and the blade 170 are integrally molded through the rotation extraction, the mold line formed on the outer surface may be minimized. Accordingly, a commercial value of the rotator 100 may be improved, structural stability such as mechanical rigidity and the like may be secured, and the blade 170 of the three-dimensional shape may be molded simply and effectively.

The moving portion that moves the extraction guide 250 may linearly move the extraction guide 250 in various schemes. For example, the moving portion may include a plate or the like that is coupled with the other end of the extraction guide 250 or supports the other end, and may be constructed to provide a moving force to the extraction guide 250 through a movement of the plate.

In one example, the extraction guide 250 may be moved linearly while being rotated inside the rotation extraction mold 230 to induce the rotation of the pillar 150. The rotation of the extraction guide 250 may be made in various schemes. For example, the moving portion may be constructed to move the extraction guide 250 in a linear direction while rotating the extraction guide 250.

In addition, the moving portion does not provide a separate driving force for rotating the extraction guide 250. A rotation inducing groove extending obliquely may be defined in the outer circumferential surface of the extraction guide 250, and a rotation inducing portion inserted into the rotation inducing groove may be formed on the rotation extraction mold 230.

The moving portion may be connected to the extraction guide 250 such that free rotation of the extraction guide 250 is allowed. As the extraction guide 250 is linearly moved while the rotation inducing portion is inserted into the rotation inducing groove extending obliquely in the outer circumferential surface, the extraction guide 250 may be rotated such that the state in which the rotation inducing portion is inserted into the rotation inducing groove is maintained. That is, the extraction guide 250 may be rotated only by the linear movement without receiving the separate driving force for the rotation.

In one example, referring back to FIG. 13, the portion of the pillar 150 and the portion of the blade 170, that is, said one end 152 of the pillar 150 facing toward the bottom portion 110 and said one end 171 of the blade 170 facing toward the bottom portion 110 may be molded in the first slide mold 220.

In the rotation extraction mold 230, the pillar 150 moves linearly while rotating, so that a portion thereof to be molded inside the rotation extraction mold 230 has the same pattern along the longitudinal direction L of the pillar 150. However, in one embodiment of the present disclosure, a portion of the rotator 100 including said one end 152 of the pillar 150 and said one end 171 of the blade 170 is molded in the first slide mold 220, so that a pattern different from that of the rest of the pillar 150 may be formed.

For example, in one embodiment of the present disclosure, said one end 171 of the blade 170 is formed by the first slide mold 220, so that said one end 171 may have various shapes distinguished from that of the rest. For example, as will be described later, at least a portion of the blade 170 may be molded such that a height thereof protruding from the pillar 150 decreases in a direction toward said one end 171.

That is, said one end 171 of the blade 170 of the rotator 100 is molded in the first slide mold 220, so that structural constraints in terms of moldability may be released, the commercial value may be improved as various shapes may be implemented, and an improved structure for forming the water flow may be obtained.

In addition, said one end 171 of the blade 170 may be molded to be spaced apart from the protrusion 130 of the bottom portion 110 based on the longitudinal direction L of the pillar 150. When said one end 171 of the blade 170 is molded in the rotation extraction mold 230, said one end 171 of the blade 170 has only the limited shape as described above, or has a shape connected to the bottom portion 110 or the protrusion 130.

One embodiment of the present disclosure molds said one end 171 of the blade 170 through the first slide mold 220, so that, as will be described later, the bottom portion 110 or the protrusion 130 and said one end 171 of the blade 170 may be spaced apart not only in the longitudinal direction L of the pillar 150 but also in the circumferential direction C of the pillar 150. Thus, when the rotator 100 rotates, it may be possible to adjust the loads of the rotator 100 and the driver 50 by properly defining a passage region to be passed by water by avoiding the blade 170, and it may be possible to form an efficient water flow.

In addition, because said one end 152 of the pillar 150 is molded inside the first slide mold 220 together with the bottom portion 110, a connection point of said one end 152 of the pillar 150 and the bottom portion 110 may be effectively molded without generating an edge, and the shape constraint may be greatly released, which may be advantageous.

Furthermore, when an entirety of said one end 152 of the pillar 150 is molded in the rotation extraction mold 230, because of a structure of the mold, at least a portion of the bottom portion 110 may be molded by the rotation extraction mold 230. In this case, when considering the rotation of the pillar 150, there is a shape constraint that at least a portion of the bottom portion 110 should have a cross-section that is rotated such that the rotation extraction is possible.

In one embodiment of the present disclosure, said one end 152 of the pillar 150 is molded by the first slide mold 220, so that the bottom portion 110 may be molded to be spaced apart from the rotation extraction mold 230, and thus design constraints in consideration of the molding process may be greatly released.

Figure 17:
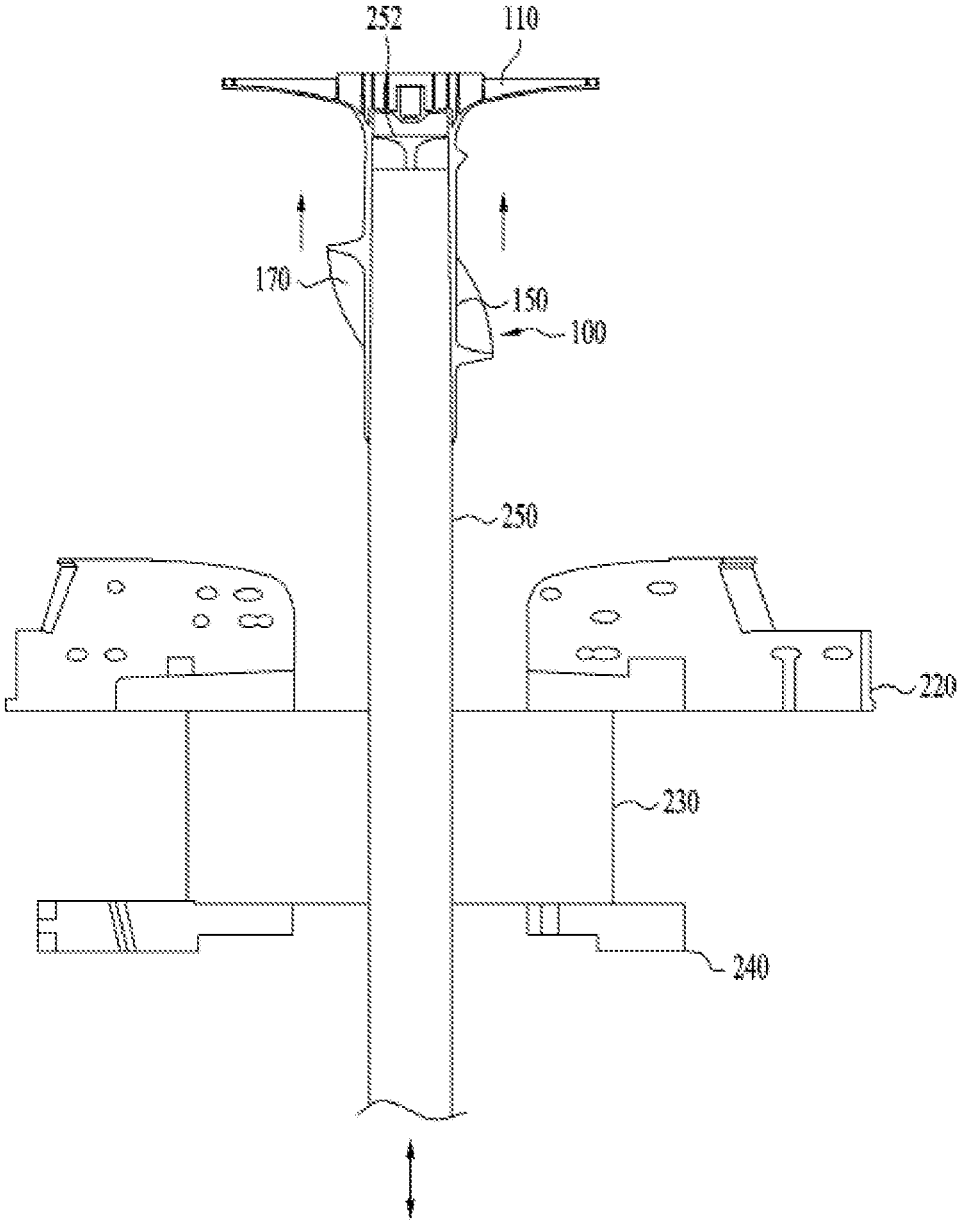
FIG. 17 is a view showing a state in which a rotator is secondarily extracted from a mold apparatus in FIG. 16.

In one example, FIG. 17 shows a secondary extraction process by the secondary extracting portion 252 after the primary extraction process in FIG. 16. In the second extraction process, as the secondary extracting portion 252 is moved from the extraction guide 250 toward the bottom portion 110 of the rotator 100, separation between the rotator 100 and the extraction guide 250 may be induced.

As for the rotator 100 extracted from the rotation extraction mold 230 by the primary extraction process, the extraction guide 250 is still located inside the pillar 150. In the molding process, an adhesive force may be generated between the inner circumferential surface of the pillar 150 and the extraction guide 250 by a frictional force or the like.

That is, the rotator 100 extracted from the rotation extraction mold 230 through the primary extraction process may still be in a disadvantageous state to be separated from the extraction guide 250.

In one embodiment of the present disclosure, the mold apparatus 200 may remove the adhesive force between the extraction guide 250 and the rotator 100 and implement a state in which the rotator 100 may be easily separated by moving the rotator 100 from the extraction guide 250 through the secondary extracting portion 252.

At least a portion of the secondary extracting portion 252 may be located on said one end of the extraction guide 250. The secondary extracting portion 252 may be constructed such that at least a portion thereof is movable from the extraction guide 250 toward the bottom portion 110 of the rotator 100. That is, the secondary extracting portion 252 may be constructed to form a relative displacement with respect to the extraction guide 250.

The secondary extracting portion 252 may be formed in various shapes and may be constructed to be movable in various schemes. For example, the secondary extracting portion 252 may be constructed such that a pressing portion that pushes the rotator 100 is located on said one end of the extraction guide 250 or forms at least a portion of said one end.

In addition, the extraction guide 250 may have a power providing portion for the movement of the secondary extracting portion 252 therein, and the movement of the secondary extracting portion 252 may be performed through the power providing portion.

Alternatively, the secondary extracting portion 252 may include an extension penetrating the extraction guide 250, the extension may be connected to the moving portion that moves the extraction guide 250, and the moving portion may be constructed to move the secondary extracting portion 252 through the extension independently of the movement of the extraction guide 250.

When the secondary extraction process is terminated, the rotator 100 may become easy to be separated from the extraction guide 250, and the rotator 100 may be removed from the mold apparatus 200 by a user, a robot, or the like.

The rotator 100 may be molded as the hot injection liquid is cooled and hardened, and cooling of the rotator 100 may be performed by an in-mold cooling or out-of-mold cooling scheme. For example, in one embodiment of the present disclosure, after the secondary extraction process, a cooling process in which the rotator 100 is subjected to the out-of-mold cooling that is performed outside the mold apparatus 200 may be performed.

The rotator 100 according to an embodiment of the present disclosure may be subjected to primary cooling at a location inside the mold apparatus 200, and may be subjected to secondary cooling at a location outside the mold apparatus 200 after the secondary extraction process is terminated.

The primary cooling may be performed before the primary extraction process as the in-mold cooling, and the secondary cooling may be performed after the secondary extraction process as the out-of-mold cooling.

The out-of-mold cooling process has an excellent cooling speed of the rotator 100 compared to the in-mold cooling process, thereby improving productivity. In addition, the rotator 100 according to one embodiment of the present disclosure may be subjected to the primary cooling at the location inside the mold apparatus 200 to minimize an amount of deformation resulted from cooling and shrinkage, and may be subjected to the out-of-mold cooling as the secondary cooling to greatly improve the productivity and lower a solidification rate of the rotator 100.

In one example, deformation of a portion of the rotator 100 may occur in the process of the out-of-mold cooling. One embodiment of the present disclosure may minimize the deformation of the rotator 100 resulted from the out-of-mold cooling through a spaced relationship of the blade 170, the protrusion 130, a reinforcing portion 116, and the like of the bottom portion 110, and the like, as will be described later.

Hereinafter, the rotator 100, at least a portion of which may be molded in the above-described scheme, will be described in detail FIG. 3 shows the rotator 100 according to one embodiment of the present disclosure, and FIG. 4 shows a side view of the rotator 100 in FIG. 3.

Referring to FIGS. 3 and 4, in one embodiment of the present disclosure, the first mold line 181 may be formed between said one end 171 of the blade 170 facing toward the bottom portion 110 and the other end 173 facing toward the open surface 31 of the drum 30 in the rotator 100 as described above. At least a portion of the first mold line 181 may extend parallel to the circumferential direction C of the pillar 150.

The blade 170 may extend obliquely with respect to the longitudinal direction L of the pillar 150 from said one end 171 facing toward the bottom portion 110 to the other end 173 facing toward the open surface 31. Because a first portion including said one end 171 and a second portion including the other end 173 may be molded by different molds, the first mold line 181 may be formed between the first portion and the second portion.

The first mold line 181 may be in a shape of a stepped boundary line between surfaces of the first portion and the second portion of the blade 170, may be in a shape protruding from the surface of the blade 170, and may be in a shape indented into the surface of the blade 170. That is, in one embodiment of the present disclosure, the mold line may have various shapes formed on a boundary line between the molds.

제 The first mold line 181 may be formed between the mold for forming the pillar 150 and the blade 170 and the mold for forming the bottom portion 110. In one embodiment of the present disclosure, the first mold line 181 may be formed between the rotation extraction mold 230 and the first slide mold 220.

The present disclosure may mold the pillar 150 and the blade 170 in the rotation extraction scheme, and mold the bottom portion 110 with the slide mold, so that the first mold line 181 extending parallel to the circumferential direction C of the pillar 150 may be formed.

That is, it means that at least a portion and the remaining portion of the rotator 100 in which the first mold line 181 extending in parallel with the circumferential direction C of the pillar 150 is formed on the surface of the blade 170 are molded on different molds along the longitudinal direction L of the pillar 150. Accordingly, even when the pillar 150 and the blade 170 are molded using the rotation extraction scheme, at least the portion of the pillar 150 and the blade 170 may be molded into various shapes through the first slide mold 220, which is advantageous.

In one example, in one embodiment of the present disclosure, the first mold line 181 may extend continuously along the outer surface of the blade 170 and the outer surface of the pillar 150. That is, in one embodiment of the present disclosure, the pillar 150 and the blade 170 may be integrally molded in the same mold.

In addition, the blade 170 may have a screw shape extending obliquely with respect to the longitudinal direction L of the pillar 150, and the scheme of molding the pillar 150 and the blade 170 in the inclined shape together may be the rotation extraction scheme.

In one embodiment of the present disclosure, the first mold line 181 extends continuously along the surfaces of the blade 170 and the pillar 150. Accordingly, at least the portion of the pillar 150 and the blade 170 may be molded in one mold, for example, the rotation extraction mold 230 to improve a manufacturing process and secure a structural stability.

In one example, the blade 170 may have a constant inclination angle with respect to the longitudinal direction L of the pillar 150 from the first mold line 181 to the other end 173. In one embodiment of the present disclosure, the pillar 150 and the blade 170 may be molded in the rotation extraction scheme. Therefore, the inclination angle of the blade 170 may be constantly maintained along the longitudinal direction L of the pillar 150.

That is, in one embodiment of the present disclosure, the inclination angle of the blade 170 is constantly maintained along the longitudinal direction L of the pillar 150, so that the blade 170 may be advantageously molded in the rotation extraction scheme.

FIG. 3 shows the blade 170 that forms the inclination angle A with respect to the circumferential direction C of the pillar 150 according to one embodiment of the present disclosure. FIG. 3 shows the inclination angle A with respect to the circumferential direction C of the pillar 150, which may be understood in the same way that the inclination angle with respect to the longitudinal direction L of the pillar 150 is maintained constant.

In one example, in one embodiment of the present disclosure, the first mold line 181 may be located closer to said one end 171 than to the other end 173 of the blade 170.

It may be understood that one portion and the remaining portion distinguished based on the first mold line 181 of the rotator 100 are molded in different molds. The first mold line 181 may be disposed closer to said one end 171 of the blade 170. The first mold line 181 may be positioned adjacent to said one end 171 of the blade 170.

That is, in the blade 170, said one end 171 may be molded together with the bottom portion 110. The remaining portion of the blade 170 except for the one end 171 may be effectively and conveniently manufactured together with the pillar 150 through the rotation extraction scheme.

In addition, in one embodiment of the present disclosure, as said one end 171 of the blade 170 is molded together with the bottom portion 110, positional relationships between said one end 171 of the blade 170 and the protrusion 130 of the bottom portion 110 or the like may be variously set, and the shape of said one end 171 of the blade 170 may also be variously molded, so that an efficient structure of the rotator 100 may be implemented.

In one example, referring to FIGS. 3 and 4, in one embodiment of the present disclosure, only one first mold line 181 may be formed on the outer surface of the blade 170.

In one embodiment of the present disclosure, said one end 171 of the blade 170 may be molded in one mold, for example, the first slide mold 220 described above, together with the bottom portion 110 for a shape advantage and an efficiency of the water flow formation.

In addition, in consideration of a manufacturing efficiency and a structural stability, an entirety of the blade 170 except for said one end 171 and an entirety of the pillar 150 may be molded through one mold, for example, the rotation extraction mold 230 described above.

The first slide mold 220 is a component for molding the bottom portion 110 of the rotator 100 based on the first mold line 181. In one embodiment of the present disclosure, the mold line is not formed after all except for the first mold line 181 on the pillar 150 and the blade 170.

That is, in one embodiment of the present disclosure, the mold line on the surface may be minimized by molding the pillar 150 including the inclined blade 170 in the inclined shape through one mold in the rotation extraction scheme, mechanical rigidity may be secured by molding the pillar 150 and the blade 170 that do not have a structural fastening relationship, and the structural stability may be secured by minimizing a difference in rigidity of portions as the pillar 150 and the blade 170 are generally molded together.

In addition, in one embodiment of the present disclosure, the rotator 100 may be rotated by the driver 50 to generate the water flow and agitate the laundry. That is, the rotator 100 may be an object in direct contact with the laundry, and as the number of mold lines on the outer surface of the rotator 100 increases, damage to the laundry by the mold lines may occur.

In one embodiment of the present disclosure, there is only one first mold line 181 on the pillar 150 and the blade 170, and the first mold line 181 has a shape extending parallel to the rotation direction of the rotator 100, so that damage to the laundry caused by the rotation of the rotator 100 may be minimized.

In one example, referring to FIG. 4, in one embodiment of the present disclosure, the blade 170 may have a first height reduction section 176 extending from the first mold line 181 to said one end 171 while gradually decreasing in a protruding height from the pillar 150.

That is, in one embodiment of the present disclosure, one portion and the remaining portion of the blade 170 distinguished based on the first mold line 181 are molded on the different molds, so that a degree of freedom for shape determination may be increased by varying the mold and characteristics of the molding scheme for each portion.

For example, an entirety of the blade 170 except for said one end 171 based on the first mold line 181 may be molded through the rotation extraction, and at the same time, said one end 171 may effectively implement a shape that is difficult to be implemented in the rotation extraction scheme using, for example, the slide mold.

The blade 170 may be formed with the first height reduction section 176 from the first mold line 181 to said one end 171. In the first height reduction section 176, the blade 170 may be constructed such that the protruding height from the outer circumferential surface of the pillar 150 is gradually reduced toward said one end 171.

The first height reduction section 176 may be formed between the first mold line 181 and said one end 171. For example, the first height reduction section 176 may be formed from the first mold line 181 or a position spaced apart from the first mold line 181 by a predetermined distance to said one end 171 of the blade 170 or a position spaced apart from said one end 171 by a predetermined distance.

The protruding height of the blade 170 in the first height reduction section 176 may be gradually reduced, and the protruding height of the blade 170 may be continuously reduced. That is, a protruding distal end of the blade 170, that is, a blade of the blade 170 may form a continuous curve.

When molding the entirety of the blade 170 in the rotation extraction scheme, an end positioned on a side from which the blade 170 is extracted from the rotation extraction mold 230 may have a shape with an edge, and the protruding height of the blade 170 may be maintained constant because of the characteristics of the rotation extraction.

When said one end 171 of the blade 170 has the shape with the edge or with the constant protruding height as described above, it may be disadvantageous in handling of the blade 170 because of the edge or the like, there may be a high possibility of damage resulted from the water resistance when the blade 170 rotates inside the drum 30, and unnecessary vortices or the like may be generated in the formation of the water flow, which may affect the washing efficiency.

Accordingly, in one embodiment of the present disclosure, said one end 171 and the other end 173 of the blade 170 may be manufactured in the different molds. The portion including the other end 173 of the blade 170 may be efficiently manufactured without forming the mold line through the rotation extraction, and the portion including said one end 171 may be molded such that the first height reduction section 176 may be formed using another mold even when the other end 173 is molded through the rotation extraction.

In one example, in one embodiment of the present disclosure, the blade 170 may be formed with a height maintaining section 177 extending between the first height reduction section 176 and the other end 173 such that a protruding height from the pillar 150 is uniform may be formed.

The height maintaining section 177 may be formed between the first height reduction section 176 and the other end 173 of the blade 170. The height maintaining section 177 may be formed from the first height reduction section 176 or a position spaced apart from the first height reduction section 176 by a predetermined distance to the other end 173 of the blade 170 or a position spaced apart from the other end 173 by a predetermined distance.

FIG. 4 shows the blade 170 in which the height maintaining section 177 is formed from the first height reduction section 176 to the position spaced apart from the other end 173 by the predetermined distance, according to one embodiment of the present disclosure.

The blade 170 having the height maintaining section 177 with the constant protruding height from the pillar 150 may be advantageous to be extracted in the rotation extraction scheme. That is, one embodiment of the present disclosure may mold the blade 170 having the height maintaining section 177 in the rotation extraction scheme using the rotation extraction mold 230.

In one example, in one embodiment of the present disclosure, the blade 170 may have a second height reduction section 178 in which the protruding height from the pillar 150 is gradually reduced from the height maintaining section 177 to the other end 173.

However, the mold line may not be formed between the second height reduction section 178 and the height maintaining section 177. That is, the second height reduction section 178 and the height maintaining section 177 may be molded in the same mold. For example, the second height reduction section 178 and the height maintaining section 177 of the blade 170 may be molded together through the rotation extraction mold 230.

In one embodiment of the present disclosure, said one end 171 of the blade 170 may be molded by a mold different from the rotation extraction mold 230, for example, the first slide mold 220 described above. Accordingly, the first height reduction section 176 may be formed regardless of the rotation extraction scheme.

In one example, the other end 173 of the blade 170 may be molded inside the rotation extraction mold 230. As said one end 171 of the blade 170 based on the first mold line 181 is manufactured in another mold, the degree of freedom in the shape may be secured. Therefore, the blade 170 may be extracted by being moved from the rotation extraction mold 230 to said one end 171. Therefore, because the other end 173 of the blade 170 is located inside the rotation extraction mold 230 and at an end of the rotation extraction mold 230 on a side opposite to a side where the extraction of the blade 170 starts, despite the rotation extraction scheme, the degree of freedom in the shape may be secured.

Accordingly, in one embodiment of the present disclosure, the second height reduction section 178 may be formed at the other end 173 of the blade 170. The second height reduction section 178 may be formed from the height maintaining section 177 or a position spaced apart from the height maintaining section 177 by a predetermined distance to the other end 173 of the blade 170 or a position spaced apart from the other end 173 by a predetermined distance.

The protruding height of blade 170 may be gradually reduced in the second height reduction section 178. In the second height reduction section 178, the protruding height of the blade 170 may be continuously reduced. That is, in the second height reduction section 178, the blade of the blade 170 may form a continuous curve.

As the second height reduction section 178 is formed, like the first height reduction section 176, it may be advantageous in the handling of the blade 170 and the damage to the laundry may be minimized because the edge or the like is removed, the damage resulted from the water resistance when the blade 170 rotates inside the drum 30 may be effectively suppressed, and the unnecessary vortices or the like may not be generated in the formation of the water flow, which may be advantageous.

Figure 5:
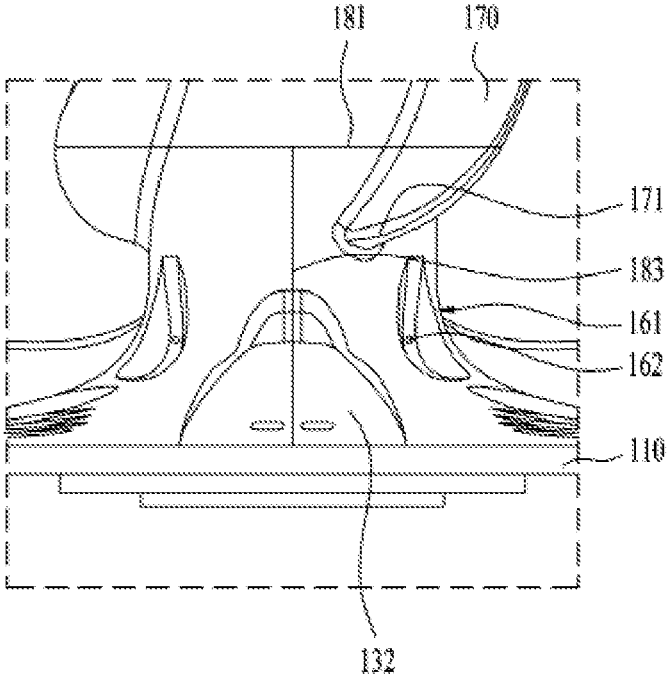
FIG. 5 is a view showing a connection portion of a pillar and a bottom portion in a rotator of a laundry treating apparatus according to an embodiment of the present disclosure.
Figure 6:
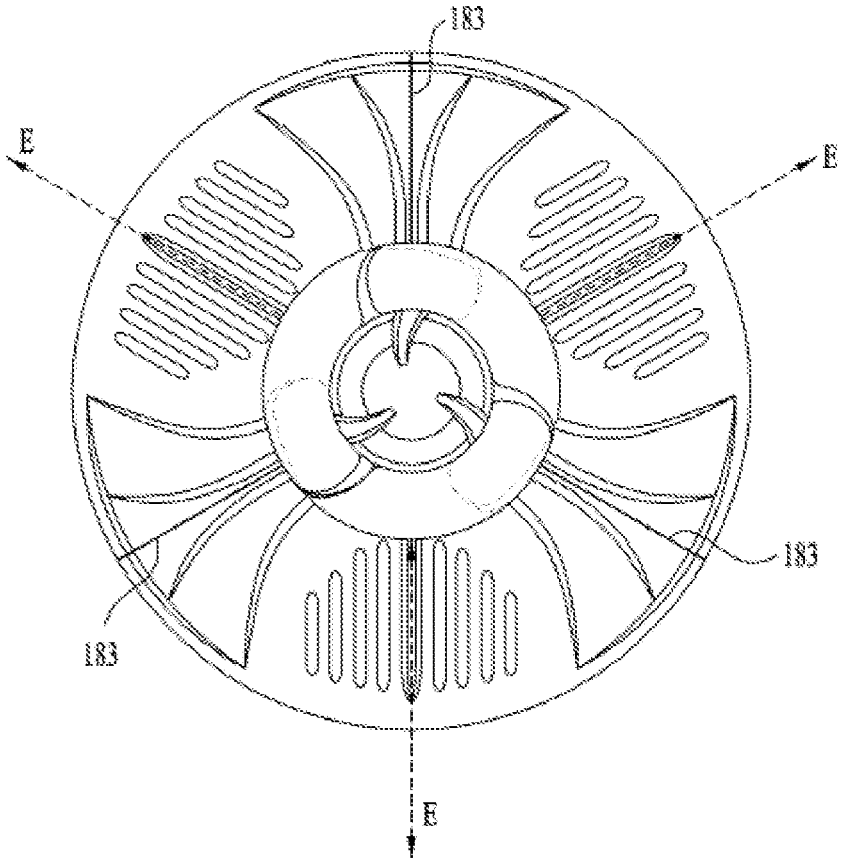
FIG. 6 is a top view of a rotator in a laundry treating apparatus according to an embodiment of the present disclosure.

In one example, FIG. 4 shows that a second mold line 183 is formed on the bottom portion 110 and said one end 152 of the pillar 150, FIG. 5 shows an enlarged view of the second mold line 183 and the first mold line 181, and FIG. 6 is a top view of the bottom portion 110 on which the second mold line 183 is formed.

Referring to FIGS. 4 to 6, in one embodiment of the present disclosure, a plurality of second mold lines 183, at least a portion of which extends in parallel with the radial direction of the bottom portion 110 may be formed on the bottom portion 110.

At least a portion of the second mold line 183 may extend parallel to the radial direction of the bottom portion 110. The second mold line 183 may be formed parallel to the radial direction of the bottom portion 110 in a top view of the rotator 100.

In the rotator 100 according to an embodiment of the present disclosure, one first mold line 181 may be formed at said one end 171 of the blade 170, and the plurality of second mold lines 183 may be formed on the bottom portion 110. The second mold line 183 may be spaced apart from each other along the circumferential direction of the bottom portion 110.

The bottom portion 110 may have the plurality of second mold lines 183 extending along the radial direction. That is, the bottom portion 110 may be formed by a plurality of molds surrounding the bottom portion 110 in the circumferential direction and moving in the radial direction. For example, the bottom portion 110 may be molded by the first slide mold 220 made of the plurality of divided bodies as described above.

Accordingly, an entirety of the outer surface of the bottom portion 110 may be molded by the mold along the circumferential direction, and an ease of the extraction may be secured through sliding of the divided bodies as the mold is composed of the plurality of divided bodies.

In one embodiment of the present disclosure, although the pillar 150 has a geometrical feature that the cross-section thereof is rotated along the longitudinal direction L by the blade 170, the bottom portion 110 does not have a shape in which a cross-section thereof is gradually rotated along the longitudinal direction L. Therefore, the bottom portion 110 based on the first mold line 181 may be molded using a mold sliding scheme instead of the rotation extraction.

In addition, the mold for molding the bottom portion 110 is composed of the plurality of divided bodies surrounding the bottom portion 110, so that the plurality of second mold lines 183 extending in the radial direction may be formed on the bottom portion 110.

In addition, as will be described later, the bottom portion 110 may include a plurality of protrusions 130 extending from a center toward a circumference of the bottom portion 110. As the mold composed of the plurality of divided bodies surrounding the bottom portion 110 is moved in the radial direction, the protrusions 130 may be effectively molded.

In one example, as shown in FIG. 6, in one embodiment of the present disclosure, the bottom portion 110 may be constructed such that the mold line other than the second mold line 183 does not exist on the outer surface thereof. As the bottom portion 110 is molded by the second slide mold 240 composed of the plurality of divided bodies, the bottom portion 110 may be integrally molded without separately manufacturing or coupling the protrusion 130 or the like, so that the mold line other than the second mold line 183 may not exist.

In one example, referring to FIGS. 4 and 5, in one embodiment of the present disclosure, the first mold line 181 may continuously extend along the outer surface of the blade 170 and the outer surface of the pillar 150, and the second mold line 183 may extend from the circumference of the bottom portion 110 to the first mold line 181.

That is, portions of the pillar 150 and the blade 170 facing toward the bottom portion 110 based on the first mold line 181 may be molded in the same mold as that of the bottom portion 110. The second mold line 183 may extend from the bottom portion 110 in parallel to the radial direction of the bottom portion 110, and may extend from the pillar 150 in the longitudinal direction L of the pillar 150.

In the top view of the rotator 100 as shown in FIG. 6, the second mold line 183 may be formed so as not to deviate from any one of virtual lines extending along the radial direction of the bottom portion 110.

In addition, in the side view of the rotator 100 as shown in FIG. 5, the second mold line 183 may be formed so as not to deviate from a center line in the longitudinal direction L of the pillar 150.

Based on the above relationship, it may be understood that an entirety of the second mold line 183 extends parallel to the radial direction of the bottom portion 110, and it may be understood that the entirety of the second mold line 183 extends parallel to the center line in the longitudinal direction L of the pillar 150.

As described above, as the portions of the pillar 150 and the blade 170 facing toward the bottom portion 110 based on the first mold line 181 are molded through the first slide mold 220 instead of the rotation extraction mold 230, the degree of freedom in the shape may be improved.

In one example, referring to FIG. 5, in one embodiment of the present disclosure, said one end 171 of the blade 170 may be spaced apart from the second mold line 183 along the circumferential direction C of the pillar 150.

That is, said one end 171 of one of the blades 170 may be molded in one of the plurality of divided bodies constituting the first slide mold 220. The first slide mold 220 may be composed of the plurality of divided bodies, and the divided bodies may be constructed to slide along the radial direction of the bottom portion 110.

A boundary line between the divided bodies may correspond to the second mold line 183. When the second mold line 183 extending from the bottom portion 110 is located on the blade 170, it may be understood that two divided bodies define a space together in forming said one end 171 of one blade 170.

As above, when the second mold line 183 is placed on the blade 170, the unnecessary second mold line 183 is formed on the surface of the blade 170 that forms the water flow, which may be disadvantageous to the formation of the water flow. In addition, as a stress concentration phenomenon or the like occurs, damage to the blade 170 may be induced depending on a load acting on the blade 170, which may be disadvantageous.

Therefore, in one embodiment of the present disclosure, improvement of a performance and a mechanical strength of the blade 170 may be promoted as said one end 171 of the blade 170 is spaced apart from the second mold line 183 along the circumferential direction C of the pillar 150, that is, said one end 171 of one blade 170 is molded in one of the divided bodies constituting the second slide mold 240.

Figure 7:
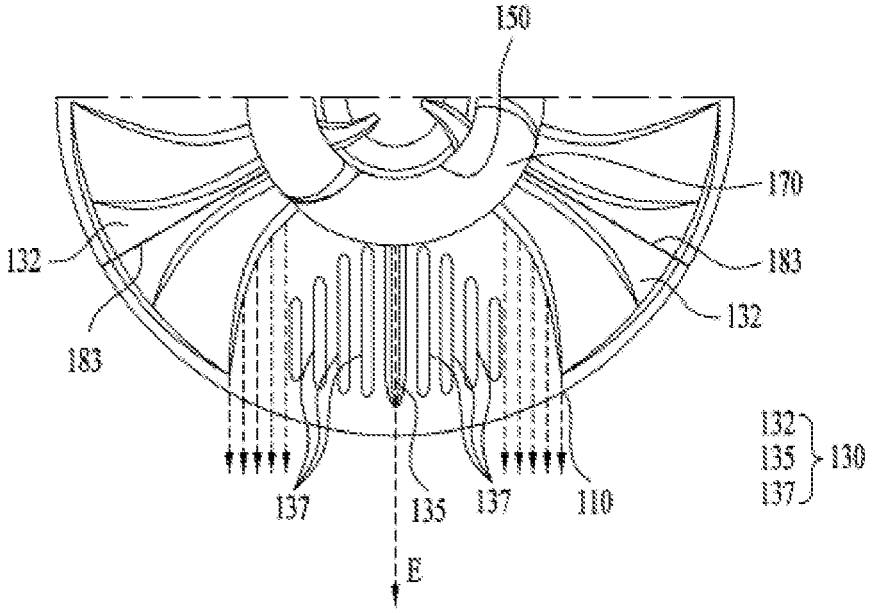
FIG. 7 is a view showing a protrusion of a rotator in a laundry treating apparatus according to an embodiment of the present disclosure.
Figure 8:
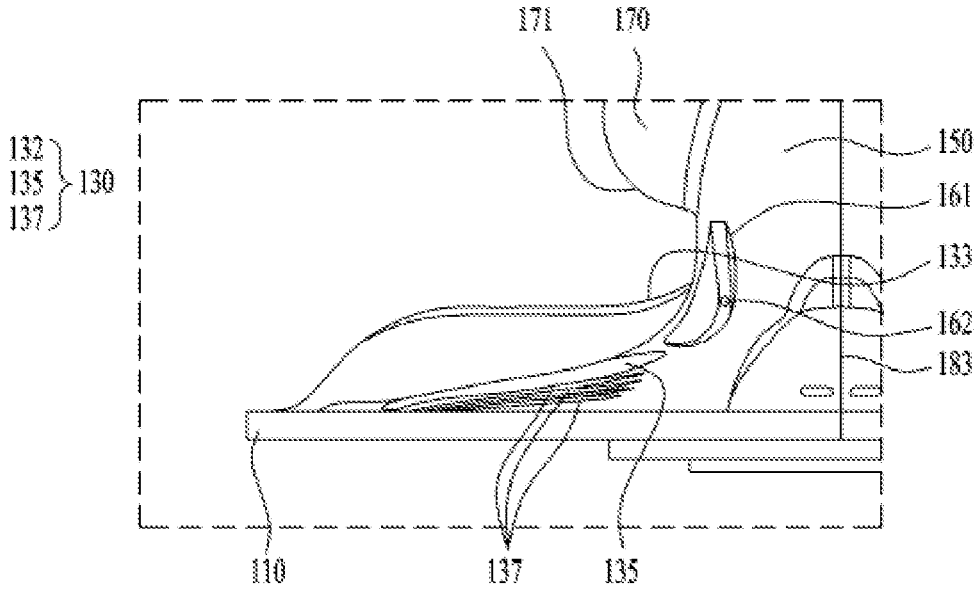
FIG. 8 is a side view of a protrusion of a rotator in an embodiment of the present disclosure.

In one example, FIG. 5 is an enlarged view of a main protrusion 132 formed on the bottom portion 110, FIG. 6 is a top view of the bottom portion 110, FIG. 7 is a top view of the protrusion 130 formed on the bottom portion 110, and FIG. 8 is a side view of the protrusion 130 formed on the bottom portion 110.

Referring to FIGS. 5 to 8, the laundry treating apparatus 1 according to one embodiment of the present disclosure may further include the protrusion 130. The protrusion 130 may include the main protrusion 132. The main protrusion 132 may protrude from the bottom portion 110 toward the open surface 31, and may extend from the pillar 150 toward the circumference of the bottom portion 110.

A centerline of the main protrusion 132 may be directed in the radial direction of the bottom portion 110. The main protrusion 132 may protrude from the bottom portion 110 toward the open surface 31 to form the water flow together with the blade 170 when the bottom portion 110 rotates. The main protrusion 132 may be formed in a shape in which an inner end 133 thereof facing toward the pillar 150 is connected to the pillar 150.

The main protrusion 132 may be integrally molded with the bottom portion 110, and may be molded inside the first slide mold 220 described above. The main protrusion 132 may have a shape of extending in the radial direction of the bottom portion 110 depending on sliding characteristics of the first slide mold 220.

In one example, referring to FIG. 5 and the like, in one embodiment of the present disclosure, said one end 171 of the blade 170 may be spaced apart from the main protrusion 132 along the longitudinal direction L of the pillar 150.

A separation space may be defined between said one end 171 of the blade 170 and the main protrusion 132. Even when the rotator 100 is rotated, water in the separation space is not induced to flow by the main protrusion 132 or the blade 170. Therefore, the load during the rotation of the rotator 100 may be adjusted through the separation space, that is, a passage region of the water.

In one example, as described above, said one end 171 of the blade 170 and the main protrusion 132 may be located together on one side with respect to the first mold line 181. That is, said one end 171 of the blade 170 and the main protrusion 132 may be molded together in any one mold, for example, the first slide mold 220 described above.

When said one end 171 of the blade 170 is molded in the rotation extraction mold 230, as described above, the shape limitation of said one end 171 of the blade 170 may occur or the situation in which said one end 171 of the blade 170 and the main protrusion 132 are integrally formed may occur.

In this case, the passage region of the water is not defined between said one end 171 of the blade 170 and the main protrusion 132, which may be disadvantageous in securing rigidity and securing structural stability.

In one embodiment of the present disclosure, said one end 171 of the blade 170 is molded together with the main protrusion 132 in a scheme other than the rotation extraction scheme, for example, the mold sliding scheme, so that the passage region of the water may be effectively defined as said one end 171 of the blade 170 is spaced apart from the main protrusion 132.

In one example, referring to FIGS. 6 and 7, in one embodiment of the present disclosure, a plurality of the main protrusions 132 may be disposed to be spaced apart from each other along the circumferential direction of the bottom portion 110, and each second mold line 183 may be formed on an outer surface of each main protrusion 132.

That is, in one embodiment of the present disclosure, one of the plurality of main protrusions 132 may be molded by a pair of neighboring divided bodies among the plurality of divided bodies constituting the first slide mold 220.

The pair of neighboring divided bodies may define together a space therebetween in which the main protrusion 132 is molded, including a boundary region between the pair of neighboring divided bodies.

The main protrusion 132 may be disposed on the bottom portion 110 to form the water flow when the rotator 100 rotates, and the outer surface of the main protrusion 132 may have various shapes for the efficient formation of the water flow.

For example, as shown in FIG. 6, the main protrusion 132 may have both side surfaces that form curved surfaces so as to be advantageous in forming the water flow. When the main protrusion 132, which may have the various shapes for the effective formation of the water flow as above, is molded in a space defined by only one divided body of the first slide mold 220, the shape of the main protrusion 132 may be constrained such that the divided body may slide.

In one embodiment of the present disclosure, the pair of neighboring divided bodies contributes to the formation of one of the plurality of main protrusions 132 that may have the various shapes for the effective formation of the water flow. Accordingly, the second mold line 183 may be positioned on a surface of the main protrusion 132.

As shown in FIG. 6, the second mold line 183 may be positioned between the both side surfaces of the main protrusion 132, and may be positioned on the centerline of the main protrusion 132 based on an extension direction of the main protrusion 132.

In one example, FIG. 6 is a top view of various types of the protrusion 130 disposed on the bottom portion 110 according to one embodiment of the present disclosure, and FIG. 8 is a side view of various types of the protrusions 130 shown in FIG. 6.

Referring to FIGS. 6 and 8, in one embodiment of the present disclosure, the rotator 100 may further include a first sub-protrusion 135. The first sub-protrusion 135 may be disposed between a pair of neighboring main protrusion 132, may protrude from the bottom portion 110 toward the open surface 31, and may extend along the radial direction of the bottom portion 110.

The first sub-protrusion 135 may contribute to the formation of the water flow when the bottom portion 110 rotates together with the main protrusion 132. The first sub-protrusion 135 may help the formation of the water flow by the main protrusion 132 to allow the efficient formation of the water flow to be performed.

The first sub-protrusion 135 may be disposed between the pair of main protrusions 132. The first sub-protrusion 135 may be located at a center of a space defined between the pair of main protrusions 132 based on the circumferential direction of the bottom portion 110. That is, the first sub-protrusion 135 may be disposed such that spaced distances thereof to the pair of main protrusions 132 positioned on both sides are the same.

The first sub-protrusion 135 may be constructed to have a height smaller than that of the main protrusion 132. That is, the first sub-protrusion 135 may assist the water flow forming effect of the main protrusion 132, and may improve the water flow forming effect by the rotation of the bottom portion 110.

The first sub-protrusion 135 may extend along the radial direction of the bottom portion 110. The shape of the first sub-protrusion 135 may vary based on need. The main protrusion 132 and the first sub-protrusion 135 may have a centerline parallel to an extension direction E thereof parallel to the radial direction of the bottom portion 110.

In one example, the protrusion 130 may further include a second sub-protrusion 137. That is, in one embodiment of the present disclosure, the bottom portion 110 may have a second sub-protrusion 137. The second sub-protrusion 137 may be disposed between the first sub-protrusion 135 and each of the pair of main protrusions 132, may protrude from the bottom portion 110 toward the open surface 31, and may extend in a direction parallel to the extension direction E of the first sub-protrusion 135.

The second sub-protrusion 137 may have a smaller protruding height than the first sub-protrusion 135. That is, in the protrusion 130 of the bottom portion 110, the first sub-protrusion 135 may have a greater protruding height than the second sub-protrusion 137, and the main protrusion 132 may have a greater protruding height than the first sub-protrusion 135.

The second sub-protrusion 137 may contribute to the formation of the water flow resulted from to the rotation of the bottom portion 110 together with the main protrusion 132 and the first sub-protrusion 135. The second sub-protrusion 137 may be constructed to increase the water flow formation effect by the main protrusion 132 and the first sub-protrusion 135.

In one embodiment of the present disclosure, as the protrusions 130 having various shapes and various heights are disposed, it is possible to form the three-dimensional water flow, thereby greatly improving the washing efficiency.

As shown in FIGS. 6 and 7, a plurality of second sub-protrusions 137 may be disposed between one main protrusion 132 and the neighboring first sub-protrusion 135. The plurality of second sub-protrusions 137 may have different lengths.

FIG. 7 shows the plurality of second sub-protrusions 137 whose extension lengths increase in a direction away from the main protrusion 132 according to one embodiment of the present disclosure. That is, the plurality of second sub-protrusions 137 may be constructed such that the extension lengths thereof increase in a direction toward the first sub-protrusion 135.

The second sub-protrusion 137 may extend in parallel with the extension direction E of the first sub-protrusion 135. Accordingly, the first sub-protrusion 135 and the second sub-protrusion 137 may be effectively molded together through the second slide mold 240.

Specifically, in one embodiment of the present disclosure, the bottom portion 110 may be molded inside the second slide mold 240, and the second slide mold 240 may be moved along the radial direction of the bottom portion 110.

The first sub-protrusion 135 may have the extension direction E parallel to the radial direction of the bottom portion 110. Accordingly, the first sub-protrusion 135 may be separated from the second slide mold 240 without geometrical interference when the second slide mold 240 moves away from the bottom portion 110.

That is, in one embodiment of the present disclosure, the extension direction E of the first sub-protrusion 135 may correspond to a sliding direction of the second slide mold 240. That is, the extension direction E of one of the plurality of first sub-protrusions 135 may coincide with a sliding direction of one of the plurality of divided bodies constituting the second slide mold.

In one example, the second sub-protrusion 137 may extend in the direction parallel to the extension direction E of the first sub-protrusion 135. When the second sub-protrusion 137 is disposed parallel to the radial direction of the bottom portion 110, because the sliding direction of the second slide mold 240 and the extension direction of the second sub-protrusion 137 are different from each other, it is difficult to form the second sub-protrusion 137 using the second slide mold 240.

Therefore, in one embodiment of the present disclosure, the plurality of second sub-protrusions 137 are disposed between the first sub-protrusion 135 and each of the pair of main protrusions 132, and the second sub-protrusion 137 extends parallel to the extension direction E of the first sub-protrusion 135, so that the first sub-protrusion 135 and the second sub-protrusion 137 may be effectively molded together by sliding of the second slide mold 240.

In one example, as described above, in one embodiment of the present disclosure, the rotator 100 may be molded in the rotation extraction scheme, and may be subjected to the out-of-mold cooling process after being extracted from the mold apparatus 200.

In the out-of-mold cooling process, shrinkage and deformation of the bottom portion 110 resulted from cooling may occur. For example, in the out-of-mold cooling process, an edge of the bottom portion 110 may ascend toward the other end 154 of the pillar 150.

In one embodiment of the present disclosure, as the plurality of protrusions 130 extending approximately in the radial direction of the bottom portion 110 are disposed on one surface of the bottom portion 110 facing the pillar 150, it is possible to minimize the deformation of the bottom portion 110 that may occur in the out-of-mold cooling process.

Figure 9:
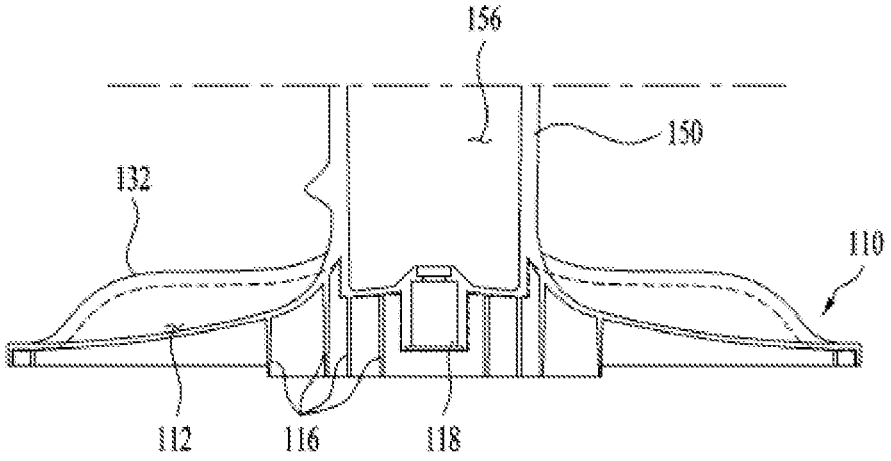
FIG. 9 is a side view of a cross-section of a bottom portion in an embodiment of the present disclosure.

In one example, FIG. 9 shows the pillar 150 in which the internal space 156 is defined according to one embodiment of the present disclosure. In addition, FIG. 3 shows a communication portion 161 positioned on the extension direction E of the first sub-protrusion 135.

Referring to FIGS. 3 and 9, in one embodiment of the present disclosure, the pillar 150 may include the internal space 156 and the communication portion 161.

The communication portion 161 may be positioned in parallel with the first sub-protrusion 135 along the radial direction of the rotator 100, may be concavely indented toward the internal space 156, and may include a communication hole 162 that communicates the internal space 156 with the outside.

As described above, the rotator 100 may be constructed such that the pillar 150 is formed in a hollow shape with the internal space 156 in order to reduce the load on the driver 50 and reduce unnecessary material consumption by reducing a weight.

However, when the pillar 150 has the internal space 156, in the washing process of the laundry put into the drum 30, detergent or foreign substances may be accumulated in the internal space 156. Therefore, it is necessary to clean the internal space 156 of the pillar 150.

To this end, in one embodiment of the present disclosure, the communication portion 161 for communicating the exterior of the pillar 150 with the internal space 156 may be defined. The communication portion 161 may be positioned in parallel with the first sub-protrusion 135.

The communication portion 161 may be defined in the outer circumferential surface of the pillar 150, may have a shape concavely indented toward the internal space 156 of the pillar 150, and may have the communication hole 162 defined therein that communicates the internal space 156 with the outside of the pillar 150.

The communication portion 161 may be concavely indented toward the internal space 156 of the pillar 150. An indentation direction of the communication portion 161 may be the same as the extension direction E of the first sub-protrusion 135. That is, the communication portion 161 may be molded by the first slide mold 220 in which the first sub-protrusion 135 is molded.

The indentation direction of the communication portion 161 may be the same as the sliding direction of the first slide mold 220. The communication portion 161 may be defined on the extension direction E of the first sub-protrusion 135, or may be spaced apart from the extension direction E of the first sub-protrusion 135. Independent of the position of the first sub-protrusion 135, the indentation direction of the communication portion 161 may coincide with a sliding direction of one of the divided bodies constituting the second slide mold 240.

In one embodiment of the present disclosure, the internal space 156 of the pillar 150 is in communication with the exterior of the pillar 150 through the communication hole 162 of the communication portion 161, so that water enters and exits the internal space 156. The cleaning of the internal space 156 may be performed through a flow of the water enters and exits the internal space 156 of the pillar 150 as the rotator 100 rotates, so that cleanliness may be improved.

In one example, referring to FIGS. 6 and 7, in one embodiment of the present disclosure, the pair of main protrusions 132 may be constructed to gradually increase in width along the circumferential direction of the bottom portion 110 from the pillar 150 toward the circumference of the bottom portion 110.

That is, the main protrusion 132 may have a shape in which the width thereof gradually decreases toward the pillar 150. The both side surfaces of the main protrusion 132 may form the curved surfaces, and the both side surfaces may have a curved shape concave toward the centerline of the main protrusion 132 or the second mold line 183.

The main protrusion 132 may be constructed to form the water flow together with the blade 170 when the rotator 100 rotates. Therefore, the main protrusion 132 may have a structure that is advantageous to form the water flow on the bottom portion 110 while having the shape in which the width thereof gradually increases from the pillar 150 toward the circumference of the bottom portion 110.

Furthermore, with the above shape, the main protrusion 132 may form the water flow toward the blade 170 when the rotator 100 rotates. As the water flow formed by the main protrusion 132 continuously reaches the blade 170, an ascending effect of the continuous water flow formed by the main protrusion 132 and the blade 170 may occur.

In one example, FIG. 7 shows the second sub-protrusion 137 and the pair of main protrusions 132 parallel to the extension direction E of the first sub-protrusion 135. Referring to FIG. 7, in one embodiment of the present disclosure, each of the pair of main protrusions 132 may be constructed such that there is no overlapping portion of a side surface thereof facing toward the first sub-protrusion 135 along a direction parallel to the extension direction E of the first sub-protrusion 135.

That is, an entirety of the side surface of each of the pair of main protrusions 132 facing toward the first sub-protrusion 135 may be exposed when viewed in the direction in parallel with the extension direction E of the first sub-protrusion 135.

As described above, one first sub-protrusion 135 may be molded in one of the divided bodies constituting the second slide core, the extension direction E of the first sub-protrusion 135 may coincide with the sliding direction of the divided bodies, and the divided bodies may form a portion of the main protrusion 132 on both sides along the circumferential direction of the bottom portion 110.

That is, one portion and the remaining portion based on the second mold line 183 of the main protrusion 132 having the second mold line 183 formed on the surface thereof may be molded in different divided bodies. In addition, the different divided bodies may have different sliding directions.

In one embodiment of the present disclosure, because the sliding direction of the first slide mold 220 may be parallel to the extension direction E of the first sub-protrusion 135, the main protrusion 132 may be constructed such that the side surface thereof facing toward the first sub-protrusion 135 does not overlap along the extension direction E of the first sub-protrusion 135.

In this case, as shown in FIG. 7, when the space defined between the pair of main protrusions 132 is viewed in the extension direction E of the first sub-protrusion 135, the entirety of the side surface of each of the pair of main protrusions 132 facing toward the first sub-protrusion 135 may be exposed. That is, the entirety of the side surface may be exposed without a portion thereof being covered by another portion.

Accordingly, the main protrusion 132, which is molded through the pair of divided bodies of the first slide mold 220, may improve the water flow formation effect by being molded in the various shapes, such as the shape in which the width thereof gradually increases in width toward the circumference of the bottom portion 110, in the molding process, unlike the first sub-protrusion 135 and the second sub-protrusion 137, and may be molded such that structural interference with the divided bodies does not occur as there is no overlapping portion of the side surface along the sliding direction of the divided bodies in the sliding process of the divided bodies.

Figure 10:
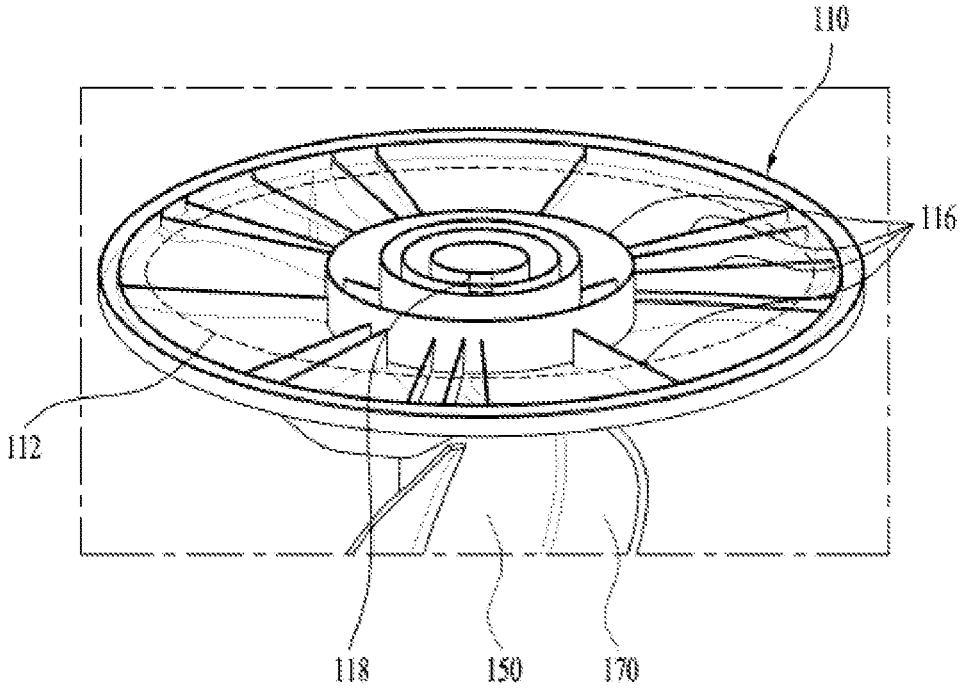
FIG. 10 is a bottom view of a bottom portion in an embodiment of the present disclosure.

In one example, FIG. 9 shows the bottom portion 110 in which the open space 112 is defined, according to an embodiment of the present disclosure, and FIG. 10 is a bottom view of the bottom portion 110. That is, FIG. 10 shows the bottom portion 110 viewed from the bottom surface 33 of the drum 30.

Referring to FIGS. 9 and 10, in one embodiment of the present disclosure, the bottom portion 110 may have the open space 112 defined therein open toward the bottom surface 33 of the drum 30, and the main protrusion 132 may have a space defined therein that defines a portion of the open space 112.

That is, the main protrusion 132 may be molded in a state in which an inner surface thereof is defined by a mold that defines the open space 112. For example, the aforementioned closing mold 210 may be positioned on one surface of the bottom portion 110 facing toward the bottom surface 33 of the drum 30, and the closing mold 210 may be constructed such that the inner surface of the main protrusion 132 is formed inside the bottom portion 110 together with the open space 112.

The main protrusion 132 may be constructed such that the space is defined therein. The space defined inside the main protrusion 132 may correspond to the portion of the open space 112 defined inside the bottom portion 110.

In one embodiment of the present disclosure, the bottom portion 110 may have the open space 112 defined therein, and said one surface of the bottom portion 110 facing toward the bottom surface 33 of the drum 30 may be opened, so that the open space 112 may be opened toward the bottom surface 33 of the drum 30.

Because the open space 112 is defined in the bottom portion 110, a load of the bottom portion 110 may be reduced, so that the load of the driver 50 may be reduced during the rotation, and the unnecessary material consumption may be reduced. In addition, the bottom portion 110 may be rotated as the second rotation shaft 42 penetrating the bottom surface 33 of the drum 30 is coupled thereto. The open space 112 may define an air region in a shaft coupling portion 118 to which the second rotation shaft 42 is coupled in the bottom portion 110, thereby preventing reduction of service lives of the second rotation shaft 42 and the shaft coupling portion 118.

Specifically, the bottom portion 110 may have the shaft coupling portion 118 to which the second rotation shaft 42 is coupled at a location inside the open space 112, and the second rotation shaft 42 and/or the shaft coupling portion 118 may contain a metal material to ensure sufficient rigidity for transmission of a rotational force for the rotation of the rotator 100.

The second rotation shaft 42 and the shaft coupling portion 118 containing the metal material may be corroded when being in contact with the water, which may adversely affect durability thereof. The shaft coupling portion 118 to which the second rotation shaft 42 is coupled in the rotator 100 may be vulnerable to damage or breakage, so that it is necessary for the shaft coupling portion 118 to be strong in terms of the service life reduction.

In one embodiment of the present disclosure, as the open space 112 is defined in the bottom portion 110 and the shaft coupling portion 118 is located inside the open space 112, even when the water is supplied into the tub 20, air that is not able to escape the open space 112 forms a layer to suppress contact of the shaft coupling portion 118 with the water.

That is, in one embodiment of the present disclosure, as the open space 112 open toward the bottom surface 33 of the drum 30 is defined in the bottom portion 110, the contact between the shaft coupling portion 118 located inside the open space 112 and the water may be suppressed and the service life reduction of the shaft coupling portion 118 may be suppressed using the air layer formed by the open space 112.

As described above, in one embodiment of the present disclosure, the closing mold 210 is disposed on one surface of the bottom portion 110, so that the bottom portion 110 having the open space 112 defined therein may be molded. As the inner surface of the main protrusion 132 is defined by the closing mold 210, the portion of the open space 112 may be defined in the main protrusion 132.

The main protrusion 132 corresponds to a protrusion 130 with a large volume among the various protrusions 130. One embodiment of the present disclosure may reduce the weight and reduce the material consumption by molding the main protrusion 132 such that the space is defined inside the main protrusion 132.

In addition, in one embodiment of the present disclosure, as the closing mold 210 movable along the longitudinal direction L of the pillar 150 is constructed to mold said one surface of the bottom portion 110, the main protrusion 132 in which the empty space is defined and the bottom portion 110 having the open space 112 defined therein may be efficiently molded together.

In one example, referring to FIG. 10, in one embodiment of the present disclosure, the bottom portion 110 may have the reinforcing portion 116 that defines the open space 112 and protrudes from an inner surface of the bottom portion 110 facing toward the bottom surface 33 of the drum 30 toward the bottom surface 33.

The reinforcing portion 116 may protrude toward the bottom surface 33 of the drum 30 from the inner surface of the bottom portion 110, that is, the inner surface surrounding the open space 112. The reinforcing portion 116 may extend along the circumferential direction or the radial direction of the bottom portion 110 to improve rigidity of the bottom portion 110, which is reduced by the open space 112.

For the rotation of the bottom portion 110, the second rotation shaft 42 and the shaft coupling portion 118 may be located inside the open space 112 of the bottom portion 110 and at the center of the bottom portion 110. The reinforcing portion 116 may include a first reinforcing portion 116 extending to surround the shaft coupling portion 118, and a second reinforcing portion 116 extending along the radial direction of the bottom portion 110.

The first reinforcing portion 116 is constructed to protrude from one of the inner surfaces of the bottom portion 110 facing toward the bottom surface 33 of the drum 30 to the bottom surface 33 and surround the shaft member, thereby inducing the formation of the air layer adjacent to the shaft member.

A plurality of first reinforcing portion 116 may have different diameters and surround the shaft member. The second reinforcing portion 116 may extend in the radial direction of the bottom portion 110 to connect the first reinforcing portions 116 to each other to increase rigidity of the first reinforcing portions 116 or may extend on the inner surface to improve rigidity of an entirety of the bottom portion 110.

In one example, in one embodiment of the present disclosure, it is possible to effectively suppress, through the reinforcing portion 116, the deformation of the bottom portion 110 that may occur in the out-of-mold cooling process. As described above, the reinforcing portion 116 may protrude from the inner surface of the bottom portion 110 and extend along the radial or circumferential direction of the bottom portion 110. Even when the bottom portion 110 has the open space 112 defined therein by the reinforcing portion 116, the deformation that may occur in the out-of-mold cooling process may be minimized.

Figure 11:
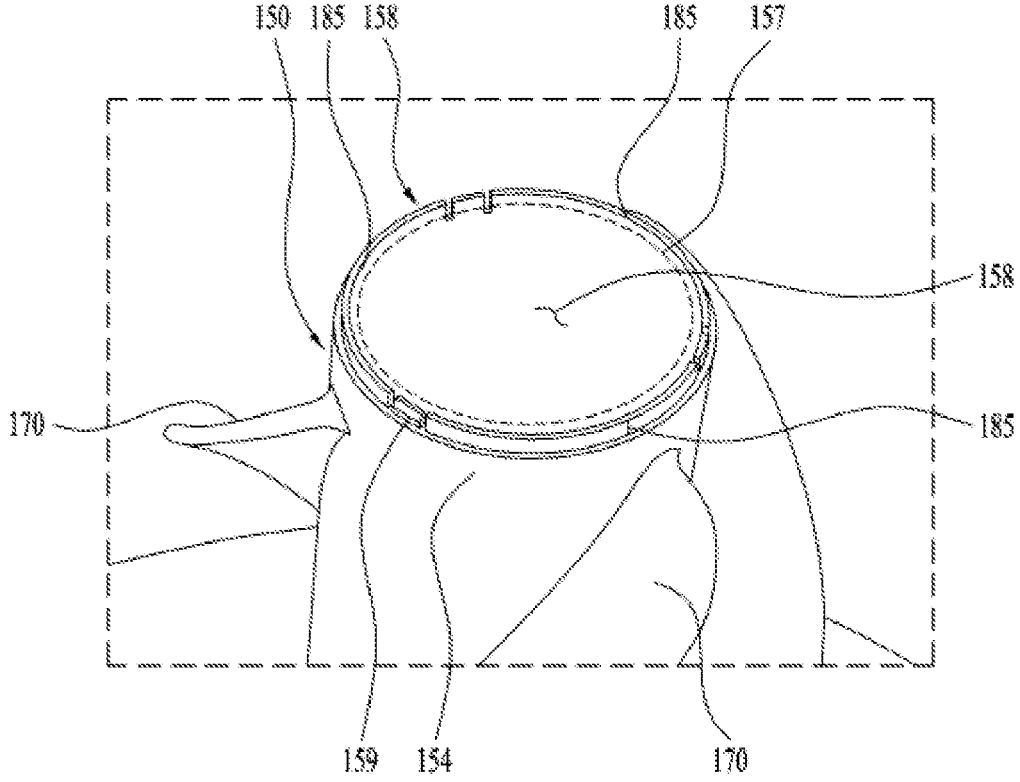
FIG. 11 is a view showing an open end of a pillar in an embodiment of the present disclosure.
Figure 12:
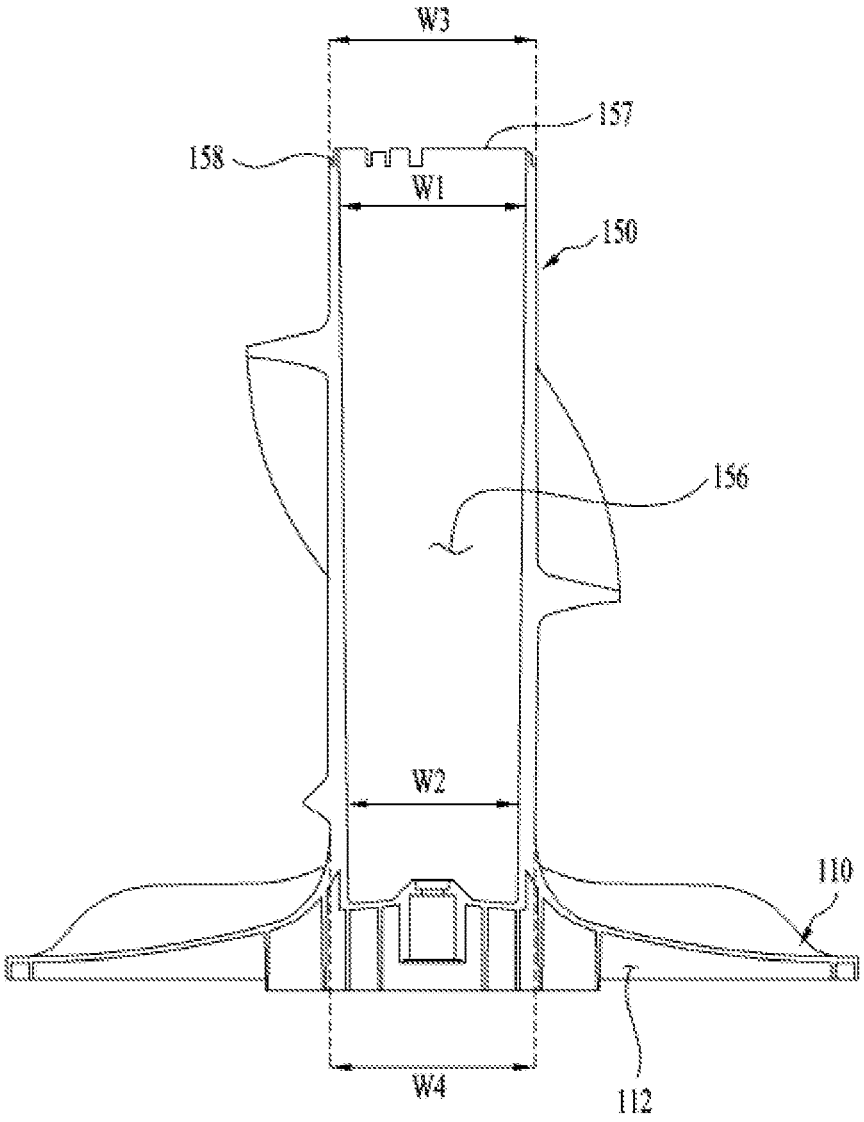
FIG. 12 is a side view of a cross-section of a rotator in a laundry treating apparatus according to an embodiment of the present disclosure.

In one example, FIG. 11 shows the cap-coupled-portion 158 disposed at the end, which is facing toward the open surface 31 of the drum 30, of the pillar 150 formed in a hollow shape according to an embodiment of the present disclosure. FIG. 12 shows a side view of a cross-section of the pillar 150 formed in the hollow shape.

Referring to FIGS. 11 and 12, in one embodiment of the present disclosure, the pillar 150 may have the internal space 156 defined therein, the end surface 157 facing toward the open surface 31 of the drum 30 may be opened, and the cap 165 that shields the end surface 157 may be coupled to the pillar 150. For reference, a state in which the cap 165 is coupled to the pillar 150 is shown in FIGS. 3 and 4.

As described above, in one embodiment of the present disclosure, the pillar 150 may be formed in the hollow shape by the rotation extraction mold 230 and the extraction guide 250. That is, the pillar 150 may have the internal space 156 defined therein.

In addition, one end of the extraction guide 250 may be inserted into the pillar 150 during the molding process. Accordingly, the end surface 157 at the end of the pillar 150 facing toward the open surface 31 of the drum 30 may be opened. The end surface 157 may be understood as one surface of the pillar 150 facing toward the open surface 31 of the drum 30.

In one example, the cap 165 may be coupled to an end of the pillar 150, for example, an upper end of the pillar 150 from which the end surface 157 is opened. The cap 165 may be coupled to the end of the pillar 150 to shield the open end surface 157.

In one embodiment of the present disclosure, the pillar 150 may be formed in the hollow shape and the end surface 157 may be opened, and the end surface 157 may be shielded by the cap 165, so that it is possible to suppress the accumulation of the foreign substances such as the detergent and the like in the internal space 156 of the pillar 150.

In one example, in one embodiment of the present disclosure, the other end 173 of the blade 170 may be spaced apart from the cap 165 along the longitudinal direction L of the pillar 150. As described above, the rotator 100 according to one embodiment of the present disclosure may be subjected to the out-of-mold cooling process, and the pillar 150 formed in the hollow shape may be deformed during the out-of-mold cooling process.

As will be described later, the cap-coupled-portion 158 to which the cap 165 is coupled may be disposed at the other end 154 of the pillar 150. When an amount of deformation of the pillar 150 is greater than an allowable deformation amount, it may be difficult for the cap 165 to be completely coupled to the cap-coupled-portion 158.

In addition, the open end surface 157 is defined at the other end 154 of the pillar 150, that is, at the end 154 of the pillar 150 facing toward the open surface 31 of the drum 30, so that an amount of deformation may be large at the end surface 157. Because the cap-coupled-portion 158 may be constructed to surround the end surface 157, an amount of deformation of the cap-coupled-portion 158 may be large.

In the out-of-mold cooling process, the amount of deformation of the other end 154 of the pillar 150, that is, the cap-coupled-portion 158, may be related to a thickness and a position of the blade 170. In the other end 154 of the pillar 150, a portion in which the blade 170 is positioned and a portion in which the blade 170 is not positioned may have different amounts of shrinkage during the cooling. Accordingly, the amount of deformation of the other end 154 of the pillar 150 on which the cap-coupled-portion 158 is disposed increases, so that the coupling between the cap 165 and the cap-coupled-portion 158 may not be easy.

As shown above, the amount of deformation of the pillar 150 resulted from the influence of the blade 170 increases as a deviation between the thickness of the blade 170 and the thickness of the pillar 150 increases. However, when the blade 170 and the open end surface 157 of the pillar 150 are spaced apart from each other, the phenomenon of the increase in the amount of deformation by the blade 170 may be greatly ameliorated.

Therefore, in one embodiment of the present disclosure, as the other end 173 of the blade 170 facing toward the end 154 of the pillar 150 is disposed to be spaced apart from the open end surface 157 of the pillar 150, the amount of deformation of the cap-coupled-portion 158 may be minimized even when the out-of-mold cooling process is performed, thereby ensuring ease of coupling between the cap 165 and the cap-coupled-portion 158.

In one example, referring to FIG. 12, in one embodiment of the present disclosure, the pillar 150 may be constructed such that an inner diameter of the pillar 150 is gradually reduced from the end facing toward the open surface 31 to the bottom portion 110.

An inner diameter of an inner circumferential surface surrounding the internal space 156 of the pillar 150 may correspond to an outer diameter of the extraction guide 250 described above. The pillar 150 may be separated from the extraction guide 250 toward said one end 152 facing toward the bottom portion 110 through the secondary extraction process.

In a case in which said one end 152 of the pillar 150 faces toward the bottom portion 110 and the other end 154 faces the open surface 31 of the drum 30, and an inner diameter W2 of said one end 152 of the pillar 150 is greater than an inner diameter W1 of the other end 154, it may be difficult for the pillar 150 to be removed from the extraction guide 250 toward said one end 152 due to structural interference with the extraction guide 250.

Therefore, in one embodiment of the present disclosure, as the inner diameter of the pillar 150 gradually decreases from the other end 154 toward said one end 152, the rotator 100 is constructed to be easily separated from the extraction guide 250 by being moved in a direction from the other end 154 toward said one end 152, so that ease of molding may be improved.

Furthermore, when the rotator 100 rotates, a structural load resulted from the resistance of water and the like may be concentrated on said one end 152 of the pillar 150 at which the pillar 150 and the bottom portion 110 are connected to each other. As the inner diameter of said one end 152 of the pillar 150 is greater than the inner diameter of the other end 154, the rigidity of the pillar 150 against the resistance of water may be effectively secured.

In one example, in one embodiment of the present disclosure, the pillar 150 may be constructed such that an outer diameter of the pillar 150 gradually increases from the end facing toward the open surface 31 to the bottom portion 110.

That is, the outer diameter of the pillar 150 may gradually increase in a direction from the end facing toward the open surface 31, that is, the other end 154, to the bottom portion 110. That is, the outer diameter of the pillar 150 may increase from the other end 154 toward said one end 152. The outer diameter of the pillar 150 may decrease from said one end 152 toward the other end 154.

In the pillar 150, the outer diameter W4 of said one end 152 may be greater than an outer diameter W3 of the other end 154. The outer diameter of the pillar 150 may correspond to a diameter of a pillar molding hole defined in the rotation extraction mold 230 described above.

The pillar 150 may be separated from the rotation extraction mold 230 by being moved from the pillar molding hole toward the bottom portion 110. When the outer diameter W4 of said one end 152 of the pillar 150 is smaller than the outer diameter W3 of the other end 154, it may be difficult to separate the pillar 150 from the pillar molding hole due to structural interference.

Therefore, in one embodiment of the present disclosure, as the outer diameter of the pillar 150 gradually increases from the other end 154 toward said one end 152, the rotator 100 is constructed to be easily separated from the rotation extraction mold 230 by being moved in the direction from the other end 154 to said one end 152, thereby improving the ease of molding.

Furthermore, when the rotator 100 rotates, the structural load resulted from the resistance of water and the like may be concentrated on said one end 152 of the pillar 150 at which the pillar 150 and the bottom portion 110 are connected to each other. As the outer diameter of said one end 152 of the pillar 150 is large, the rigidity of the pillar 150 against the resistance of water may be effectively secured.

In one example, referring to FIG. 11, in one embodiment of the present disclosure, the pillar 150 may have the cap-coupled-portion 158 to which the cap 165 is coupled at the end facing toward the open surface 31, the cap-coupled-portion 158 may be constructed to surround the end surface 157, and a third mold line 185 extending parallel to the longitudinal direction L of the pillar 150 may be formed.

The cap-coupled-portion 158 may be constructed at the end of the pillar 150 facing toward the open surface 31 of the drum 30. The cap-coupled-portion 158 may constitute a portion of the end of the pillar 150. The cap-coupled-portion 158 may be integrally formed with the end of the pillar 150.

The rotation extraction mold 230 has the blade molding groove defined in an inner circumferential surface of the pillar molding hole, and the cap-coupled-portion 158 does not have a shape in which the cross-section is rotated based on a difference in the position along the longitudinal direction L of the pillar 150, so that there may be restrictions on the molding by the rotation extraction mold 230.

In one embodiment of the present disclosure, as described above, the cap-coupled-portion 158 of the pillar 150 may be molded using the second slide mold 240. In the molding process of the rotator 100, the extraction guide 250 may be positioned on the inner circumferential surface of the cap-coupled-portion 158, and the second slide mold 240 may be positioned on the outer circumferential surface of the cap-coupled-portion 158.

As described above, the second slide mold 240 may be composed of the plurality of divided bodies, and the plurality of divided bodies may be disposed to surround the cap-coupled-portion 158 to form the cap-coupled-portion 158 together.

The second slide mold 240 composed of the plurality of divided bodies may be constructed to be movable along the radial direction of the pillar 150 such that the rotator 100 may be separated from the rotation extraction mold 230.

The cap-coupled-portion 158 is molded by the cap-coupled-portion 158 composed of the plurality of divided bodies, so that the third mold line 185 extending parallel to the longitudinal direction L of the pillar 150 may be formed on the outer surface of the cap-coupled-portion 158 by an arrangement relationship and a sliding direction of the plurality of divided bodies. The third mold line 185 may be formed at a boundary between the divided bodies constituting the second slide mold 240.

There may be a plurality of third mold lines 185. The third mold lines 185 may be spaced apart from each other along a circumference of the cap-coupled-portion 158, and the number of third mold lines 185 may be changed to correspond to the number of divided bodies constituting the second slide mold 240.

In one embodiment of the present disclosure, the entirety of the pillar 150 and the entirety of the blade 170 may be molded in the rotation extraction mold 230 through the rotation extraction scheme, and the cap-coupled-portion 158 formed at the end of the pillar 150 may be molded through the second slide mold 240, so that a design limit of the cap-coupled-portion 158 may be improved, and various shapes of the cap-coupled-portion 158 may be implemented.

Referring to FIG. 11, in one embodiment of the present disclosure, the cap-coupled-portion 158 may include a hook 159 coupled to the cap 165, the plurality of third mold lines 185 may be disposed to be spaced apart from each other along the circumferential direction C of the pillar 150, and each hook 159 may be positioned between a pair of adjacent third mold lines 185.

That is, each of the plurality of divided bodies constituting the second slide mold 240 may be constructed to mold each hook 159. When the hook 159 is molded together by a plurality of divided bodies, the third mold line 185 may be formed on the hook 159. In this case, defects in coupling between the cap 165 and the hook 159 may increase, and an unnecessary decrease in rigidity may occur.

Therefore, in one embodiment of the present disclosure, because the third mold line 185 is formed while avoiding the hook 159, the coupling between the hook 159 and the cap 165 may be improved and the rigidity may be effectively improved.

Although the present disclosure has been illustrated and described in relation to a specific embodiment, it is understood that the present disclosure may be variously improved and changed within the scope of the technical idea of the present disclosure provided by the following claims. Therefore, the scope of the present disclosure should not be limited to the described embodiment and should be defined by the claims described later as well as the equivalents of the claims.

What is claimed is:

1. A laundry treating apparatus comprising:

a tub configured to accommodate water;

a drum rotatably disposed inside the tub, the drum having an open surface configured to receive laundry therethrough and a bottom surface located at an opposite side of the open surface; and a rotator rotatably disposed inside the drum, wherein the rotator comprises:

a bottom portion positioned at the bottom surface of the drum, a pillar that protrudes from the bottom portion toward the open surface of the drum, and a blade that is disposed at an outer circumferential surface of the pillar and extends obliquely with respect to a longitudinal direction of the pillar, wherein the blade extends from a first end thereof facing the bottom portion to a second end thereof facing the open surface of the drum, wherein the rotator includes a first mold line that at least partially extends along a circumferential direction of the pillar and that is disposed between the first end of the blade and the second end of the blade, wherein the first mold line is continuous through both the pillar and the blade and extends continuously along an outer surface of the blade and the outer circumferential surface of the pillar, wherein the rotator further includes a plurality of second mold lines that extend in a radial direction of the bottom portion and that are disposed at the bottom portion, and wherein the bottom portion includes no additional mold lines on an outer surface of the bottom portion other than the plurality of second mold lines.

2. The laundry treating apparatus of claim 1, wherein an inclination angle of the blade with respect to the longitudinal direction of the pillar is constant from the first mold line to the second end of the blade.

3. The laundry treating apparatus of claim 1, wherein the first mold line is located closer to the first end of the blade than to the second end of the blade, and wherein the blade has no additional mold line on the outer surface of the blade other than the first mold line.

4. The laundry treating apparatus of claim 1, wherein the blade includes:

a first height reduction section that extends from the first mold line to the first end of the blade, a protruding height of the blade from the pillar decreasing in the first height reduction section toward the first end of the blade; and a height maintaining section that extends between the first height reduction section and the second end of the blade, the protruding height of the blade being constant in the height maintaining section.

5. The laundry treating apparatus of claim 4, wherein the blade further includes:

a second height reduction section that extends from the height maintaining section to the second end of the blade, the protruding height of the blade decreasing in the second height reduction section toward the second end of the blade.

6. The laundry treating apparatus of claim 1, wherein the plurality of second mold lines extend from a circumference of the bottom portion to the first mold line.

7. The laundry treating apparatus of claim 6, wherein the first end of the blade is spaced apart from each of the plurality of second mold lines in the circumferential direction of the pillar.

8. The laundry treating apparatus of claim 1, wherein the rotator further comprises a main protrusion that protrudes from the bottom portion toward the open surface of the drum and that extends from the pillar toward a circumference of the bottom portion, and wherein the first end of the blade is spaced apart from the main protrusion in the longitudinal direction of the pillar.

9. The laundry treating apparatus of claim 8, wherein the bottom portion defines an open space facing the bottom surface of the drum, wherein a portion of the open space of the bottom portion is defined inside the main protrusion, and wherein the bottom portion further comprises a reinforcing portion that protrudes from an inner surface of the bottom portion toward the bottom surface of the drum, the inner surface of the bottom portion defining the open space of the bottom portion.

10. The laundry treating apparatus of claim 1, wherein the rotator further comprises a plurality of main protrusions that are spaced apart from one another along the circumferential direction of the bottom portion, and wherein each of the plurality of second mold lines is disposed at an outer surface of one of the plurality of main protrusions.

11. The laundry treating apparatus of claim 10, wherein the rotator further comprises:

a first sub-protrusion disposed between a pair of neighboring main protrusions among the plurality of main protrusions, the first sub-protrusion protruding from the bottom portion toward the open surface of the drum and extending along the radial direction of the bottom portion; and a plurality of second sub-protrusions disposed between the first sub-protrusion and one of the plurality of main protrusions, each of the plurality of second sub-protrusions protruding from the bottom portion toward the open surface of the drum and extending parallel to the first sub-protrusion.

12. The laundry treating apparatus of claim 11, wherein the pillar defines an internal space therein, and wherein the pillar comprises a communication portion that defines a communication hole in communication with the internal space of the pillar and an outside of the pillar, the communication portion facing the first sub-protrusion along the radial direction and being concavely indented from an outer surface of the pillar toward the internal space of the pillar.

13. The laundry treating apparatus of claim 11, wherein a distance between the pair of neighboring main protrusions in the circumferential direction of the bottom portion increases from the pillar toward a circumference of the bottom portion, and wherein each of the pair of neighboring main protrusions has a side surface facing the first sub-protrusion, the side surface having no overlapping portion with another part of the bottom portion along a direction parallel to an extension direction of the first sub-protrusion.

14. The laundry treating apparatus of claim 1, wherein the pillar defines an internal space therein and an end surface that faces the open surface of the drum, the end surface being in communication with the internal space of the pillar, and wherein the rotator further comprises a cap that is coupled to the pillar and that covers the end surface of the pillar.

15. The laundry treating apparatus of claim 14, wherein an inner diameter of the pillar decreases from the end surface of the pillar toward the bottom portion, and wherein an outer diameter of the pillar increases from the end surface of the pillar toward the bottom portion.

16. The laundry treating apparatus of claim 14, wherein the pillar has a cap-coupled portion coupled to the cap and disposed at an end portion of the pillar facing the open surface of the drum, the cap-coupled portion surrounding the end surface of the pillar, and wherein the rotator includes an end mold line that is disposed at the cap-coupled portion and that extends parallel to the longitudinal direction of the pillar.

17. The laundry treating apparatus of claim 16, wherein the pillar comprises a hook disposed at the cap-coupled portion and coupled to the cap, and wherein the end mold line comprises a plurality of end mold lines spaced apart from one another in the circumferential direction of the pillar, the hook being positioned between a pair of neighboring end mold lines among the plurality of end mold lines.

18. A laundry treating apparatus comprising:

a tub configured to accommodate water;

a drum rotatably disposed inside the tub, the drum having an open surface configured to receive laundry therethrough and a bottom surface located at an opposite side of the open surface; and a rotator rotatably disposed inside the drum, wherein the rotator comprises:

a bottom portion positioned at the bottom surface of the drum, a pillar that protrudes from the bottom portion toward the open surface of the drum, and a blade that is disposed at an outer circumferential surface of the pillar and extends obliquely with respect to a longitudinal direction of the pillar, wherein the blade extends from a first end thereof facing the bottom portion to a second end thereof facing the open surface of the drum, wherein the blade includes:

a first portion including the first end of the blade, a second portion including the second end of the blade, and a first mold line disposed between the first portion and the second portion, the first mold line being formed from molds used to define the first portion of the blade and the second portion of the blade, wherein the first mold line extends continuously along an outer surface of the blade and the outer circumferential surface of the pillar, wherein the rotator further includes a plurality of second mold lines that extend in a radial direction of the bottom portion and that are disposed at the bottom portion, and wherein the bottom portion includes no additional mold lines on an outer surface of the bottom portion other than the plurality of second mold lines.

* * * * *